US010442224B2

(12) United States Patent
Oguchi et al.

(10) Patent No.: US 10,442,224 B2
(45) Date of Patent: Oct. 15, 2019

(54) PRINTING APPARATUS

(71) Applicant: FUJITSU COMPONENT LIMITED, Tokyo (JP)

(72) Inventors: Tatsuya Oguchi, Tokyo (JP); Sumio Watanabe, Tokyo (JP); Yukihiro Mori, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/993,820

(22) Filed: May 31, 2018

(65) Prior Publication Data

US 2018/0370262 A1 Dec. 27, 2018

(30) Foreign Application Priority Data

Jun. 21, 2017 (JP) ..... 2017-121112

(51) Int. Cl.

| | |
|---|---|
| ***B41J 29/02*** | (2006.01) |
| ***B41J 2/32*** | (2006.01) |
| ***B41J 3/36*** | (2006.01) |
| ***B41J 3/44*** | (2006.01) |
| ***B41J 29/04*** | (2006.01) |
| ***B41J 29/13*** | (2006.01) |
| ***B41J 11/00*** | (2006.01) |

(52) U.S. Cl.

CPC ..... *B41J 29/02* (2013.01); *B41J 2/32* (2013.01); *B41J 3/36* (2013.01); *B41J 3/44* (2013.01); *B41J 3/445* (2013.01); *B41J 11/007* (2013.01); *B41J 29/023* (2013.01); *B41J 29/04* (2013.01); *B41J 29/13* (2013.01)

(58) Field of Classification Search

CPC ..... B41J 29/02; B41J 2/32; B41J 3/36; B41J 11/0015; B41J 11/002; B41J 11/007; B41J 11/008

USPC ..... 347/101, 104, 108, 109

See application file for complete search history.

(56) References Cited

U.S. PATENT DOCUMENTS

| | | | | |
|---|---|---|---|---|
| 6,270,271 | B1 | 8/2001 | Fujiwara | |
| 6,951,390 | B2 * | 10/2005 | King | A63F 13/00 347/103 |
| 7,426,044 | B2 * | 9/2008 | Lapstun | B41J 2/01 355/19 |
| 2007/0184879 | A1 | 8/2007 | Nakai | |

FOREIGN PATENT DOCUMENTS

| | | |
|---|---|---|
| AU | 2004201738 | 5/2004 |
| JP | 2001-253137 | 9/2001 |
| JP | 2003-094750 | 4/2003 |
| JP | 2003-256075 | 9/2003 |

* cited by examiner

*Primary Examiner* — An H Do

(74) *Attorney, Agent, or Firm* — IPUSA, PLLC

(57) ABSTRACT

A printing apparatus includes a printer, a baseplate, a jacket, and a container. The printer is configured to perform printing on a recording sheet. The baseplate holds the printer. The jacket is attached to a first surface of the baseplate, and is configured to hold an information terminal. The container is attached to a second surface of the baseplate facing away from the first surface, and is configured to store the recording sheet.

10 Claims, 24 Drawing Sheets

PRINTING APPARATUS

CROSS-REFERENCE TO RELATED APPLICATION

The present application is based upon and claims priority to Japanese Patent Application No. 2017-121112, filed on Jun. 21, 2017, the entire contents of which are incorporated herein by reference.

BACKGROUND OF THE INVENTION

1. Field of the Invention

The present invention relates to printing apparatuses.

2. Description of the Related Art

Conventional portable printers have a box shape and are relatively large, and are carried in a bag or the like. Such printers require recording paper and a holder for storing recording paper, which as well are often carried together with printers. Reference may be made to Japanese Laid-open Patent Publication Nos. 2003-94750 and 2003-256075 for related art.

SUMMARY OF THE INVENTION

According to an aspect of the present invention, a printing apparatus includes a printer, a baseplate, a jacket, and a container. The printer is configured to perform printing on a recording sheet. The baseplate holds the printer. The jacket is attached to a first surface of the baseplate, and is configured to hold an information terminal. The container is attached to a second surface of the baseplate facing away from the first surface, and is configured to store the recording sheet.

DESCRIPTION OF THE EMBODIMENTS

Figure 1:
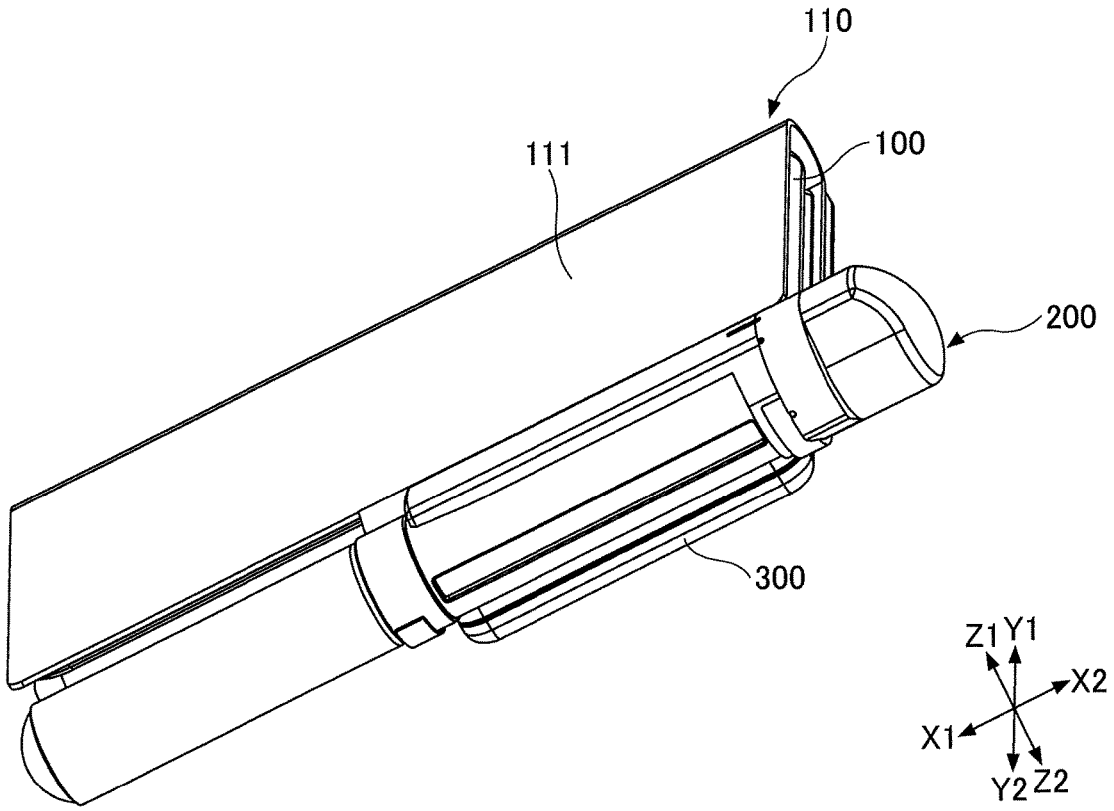
FIG. 1 is a perspective view of a printing apparatus according to an embodiment.

In recent years, portable information terminals such as smartphones have been widely used, and it is desirable that printing be performed using a portable information terminal just as using other information terminals. Because such information terminals are characterized by their portability, printing apparatuses to connect to information terminals as well are preferably small with high portability.

Therefore, there is a demand for small, easy-to-carry printing apparatuses connectable to portable information terminals.

According to an aspect of the present invention, a small, easy-to-carry printing apparatus connectable to information terminals is provided.

One or more embodiments of the present invention are described below with reference to the accompanying drawings. In the following description, the same members or components are referred to using the same reference numeral, and a repeated description thereof may be omitted.

Furthermore, the embodiments are described using an XYZ coordinate system as defined as illustrated in the drawings. A direction along the X-axis is referred to as "X direction." A direction along the Y-axis is referred to as "Y direction." A direction along the Z-axis is referred to as "Z direction." The X direction, the Y direction, and the Z direction are perpendicular to one another. A plane including the X direction and the Y direction is referred to as "XY plane." A plane including the Y direction and the Z direction is referred to as "YZ plane." A plane including the Z direction and the X direction is referred to as "ZX plane."

Figure 2:
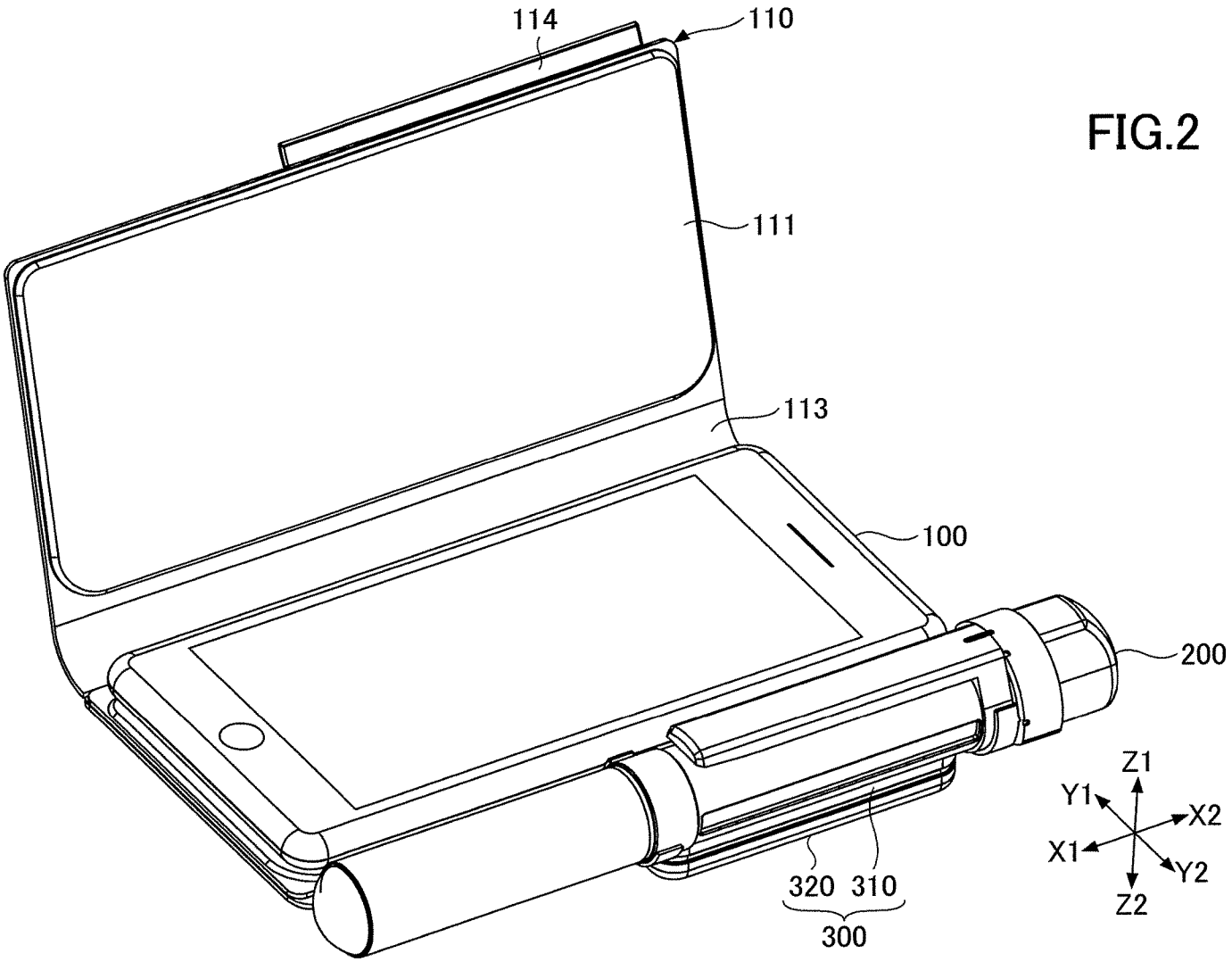
FIG. 2 is another perspective view of the printing apparatus according to the embodiment.
Figure 3:
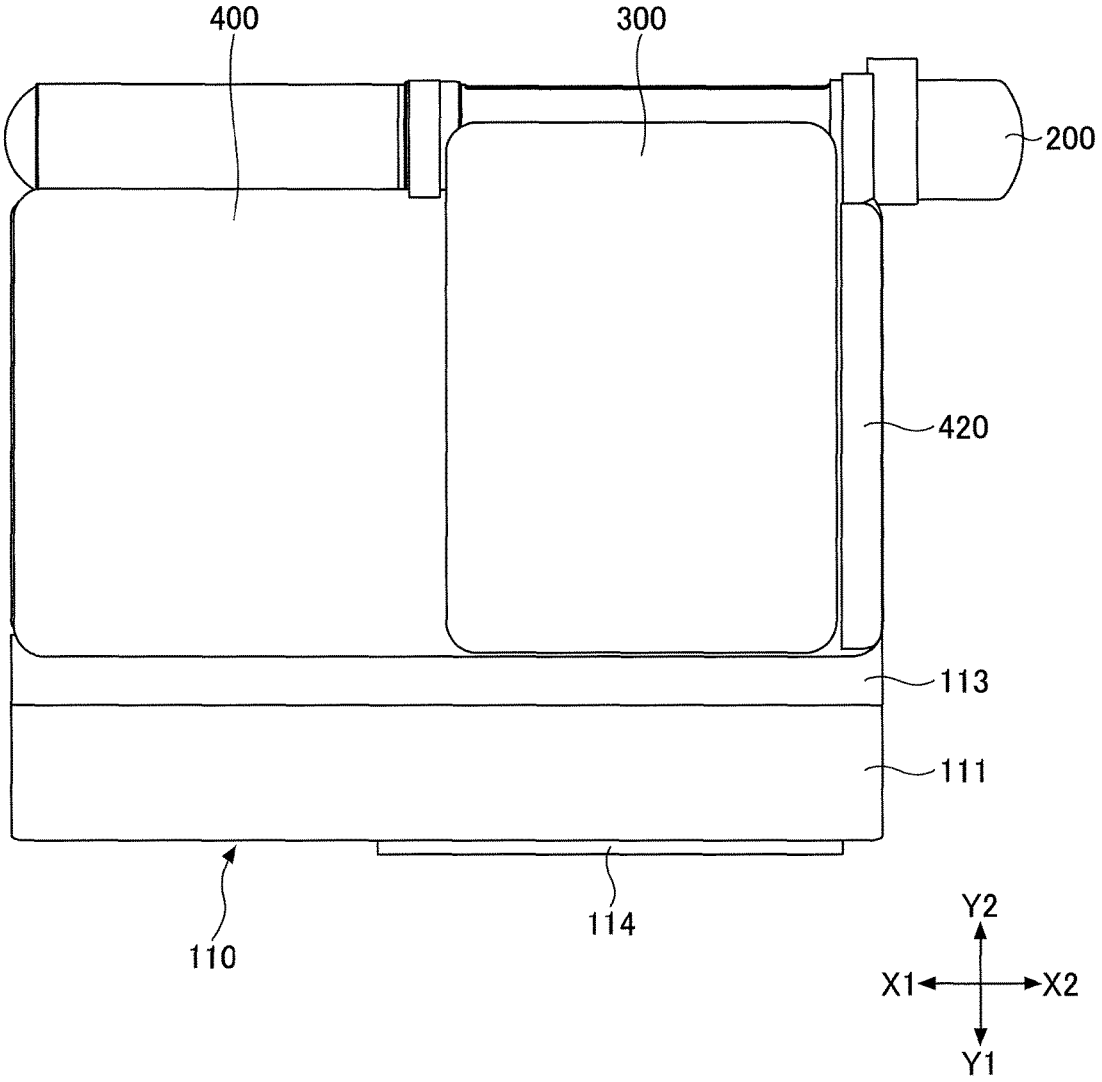
FIG. 3 is a bottom view of the printing apparatus according to the embodiment.
Figure 4:
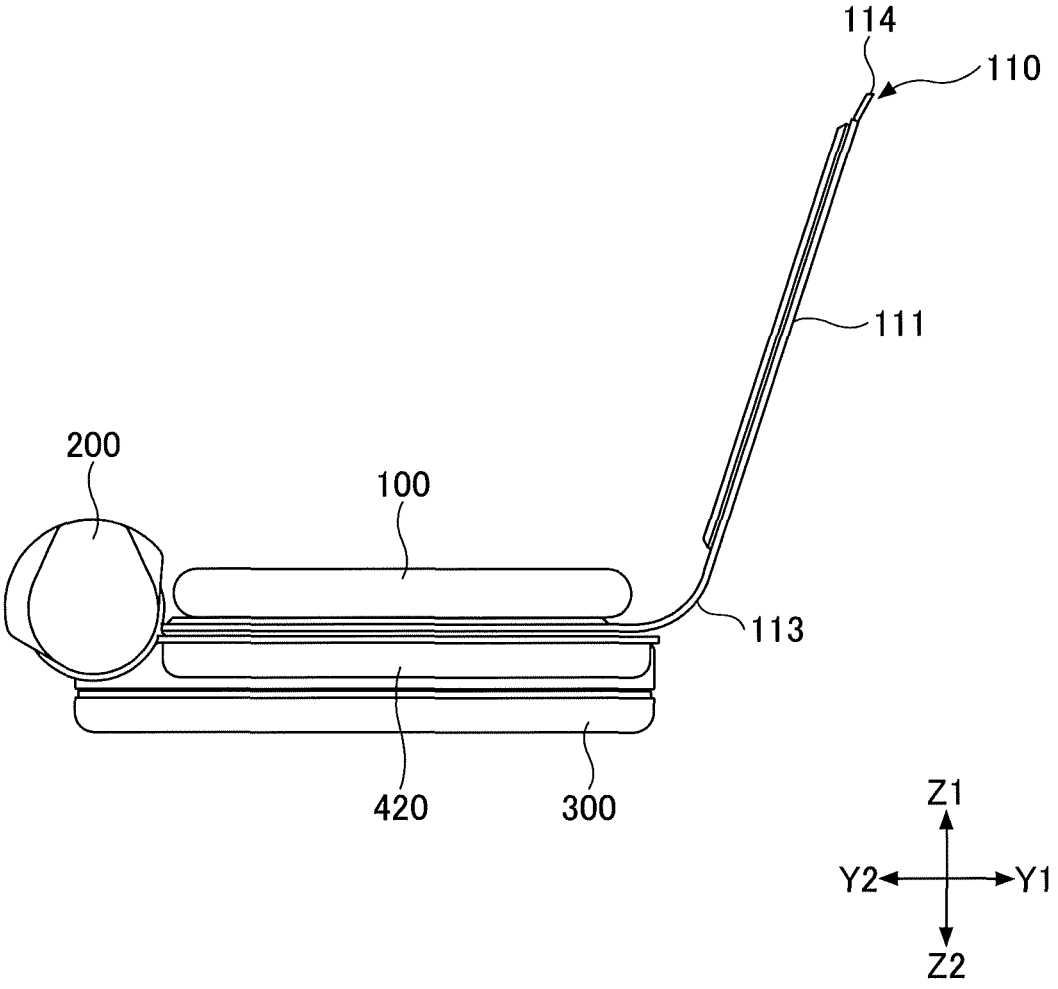
FIG. 4 is a side view of the printing apparatus according to the embodiment.
Figure 5:
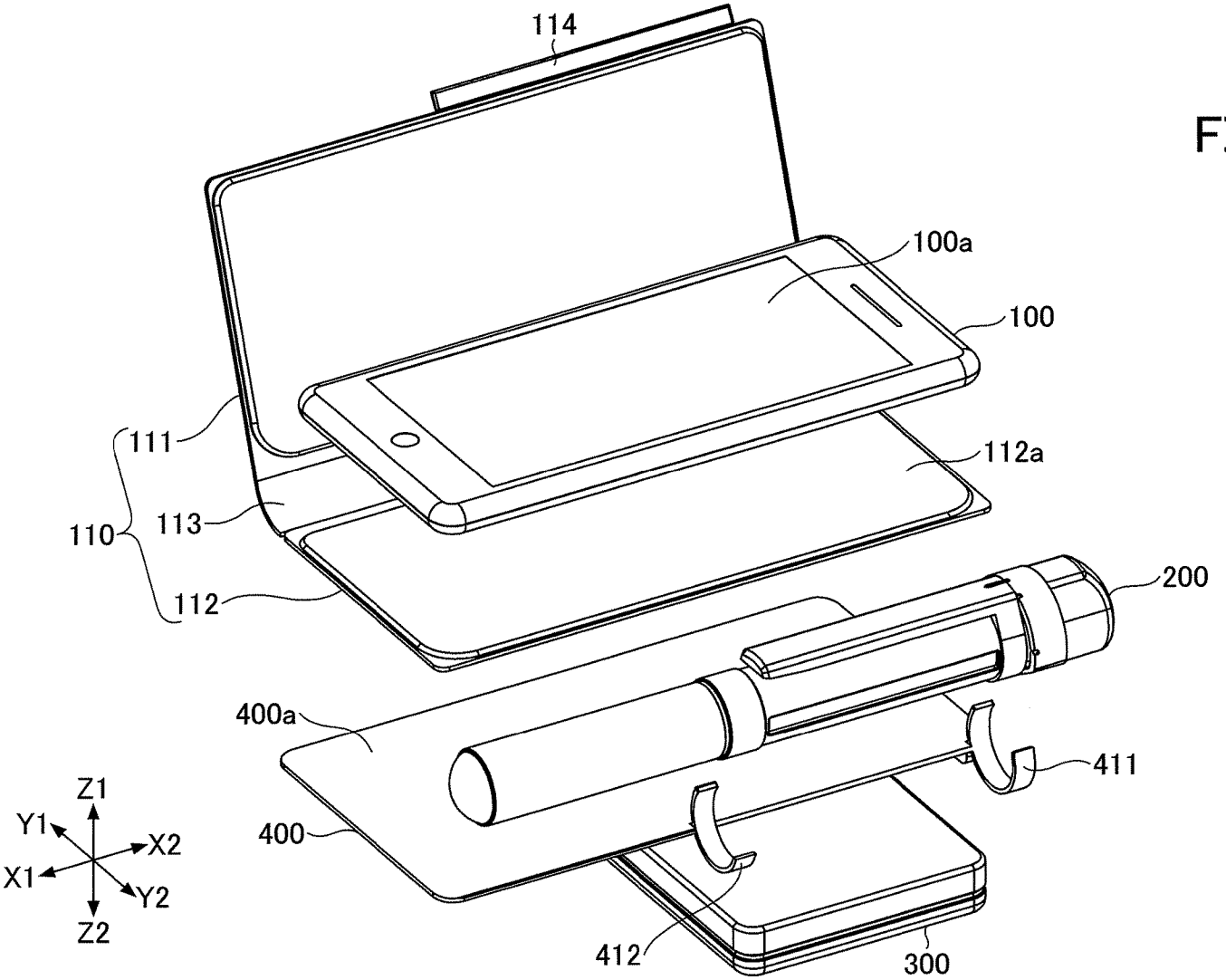
FIG. 5 is an exploded perspective view of the printing apparatus according to the embodiment.
Figure 6:
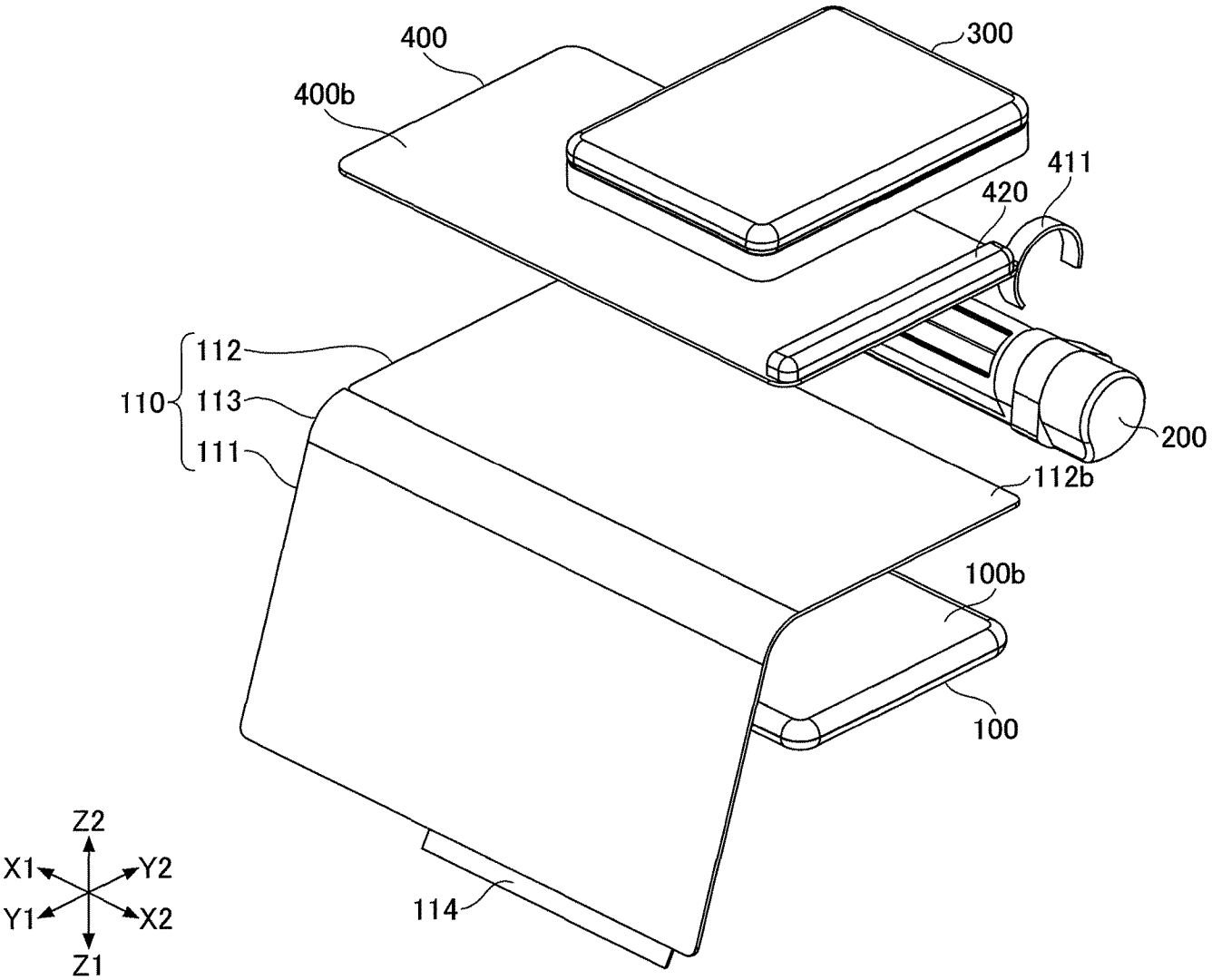
FIG. 6 is another exploded perspective view of the printing apparatus according to the embodiment.

A printing apparatus according to an embodiment is described with reference to FIGS. 1 through 6. FIG. 1 is a perspective view of the printing apparatus of this embodiment. FIGS. 2, 3 and 4 are a perspective view, a bottom view, and a side view, respectively, of the printing apparatus with an upper cover of a jacket being open. FIGS. 5 and 6 are a top-side exploded perspective view and a bottom-side exploded perspective view, respectively, of the printing apparatus.

The printing apparatus of this embodiment prints information received from a portable information terminal 100 such as a smartphone on recording paper. The printing apparatus includes a smartphone jacket (hereinafter "jacket") 110, a pen-type printer 200, a cassette 300 that stores recording paper, and a baseplate 400. The cassette 300 is an example of a container that holds recording paper. The printing apparatus may use the printer 200 to print information received from other apparatuses using the information terminal 100.

The jacket 110 is formed of, for example, synthetic leather. The information terminal 100 has a slightly thick flat-plate shape, being longer in the X direction than in the Y direction to be substantially rectangular. The jacket 110 includes an upper cover 111 and a lower cover 112 that correspond in shape to the information terminal 100. The jacket 110 further includes a foldable part 113 that is elongated in the X direction at the Y1-side edge of the jacket 110 to connect the upper cover 111 and the lower cover 112.

When the information terminal 100 is attached to the jacket 110, the information terminal 100 is held between the upper cover 111 and the lower cover 112. Specifically, a back surface 100*b* of the information terminal 100 is placed on an inside surface 112*a* of the lower cover 112, and the jacket 110 is folded at the foldable part 113 to close the upper cover 111, so that a front surface 100*a* of the information terminal 100 is covered with the upper cover 111 and the back surface 100*b* is covered with the lower cover 112.

A magnetic part 114 containing a magnet is provided on the upper cover 111 on the side opposite from the side on which the upper cover 111 connects to the foldable part 113. The printing apparatus further includes clips 411 and 412 that hold the printer 200. Part of the clips 411 and 412 contains a magnetic material and is attracted to the magnet by its magnetic force. The information terminal 100 can be kept covered with the upper cover 111 by using the magnet.

Figure 7:
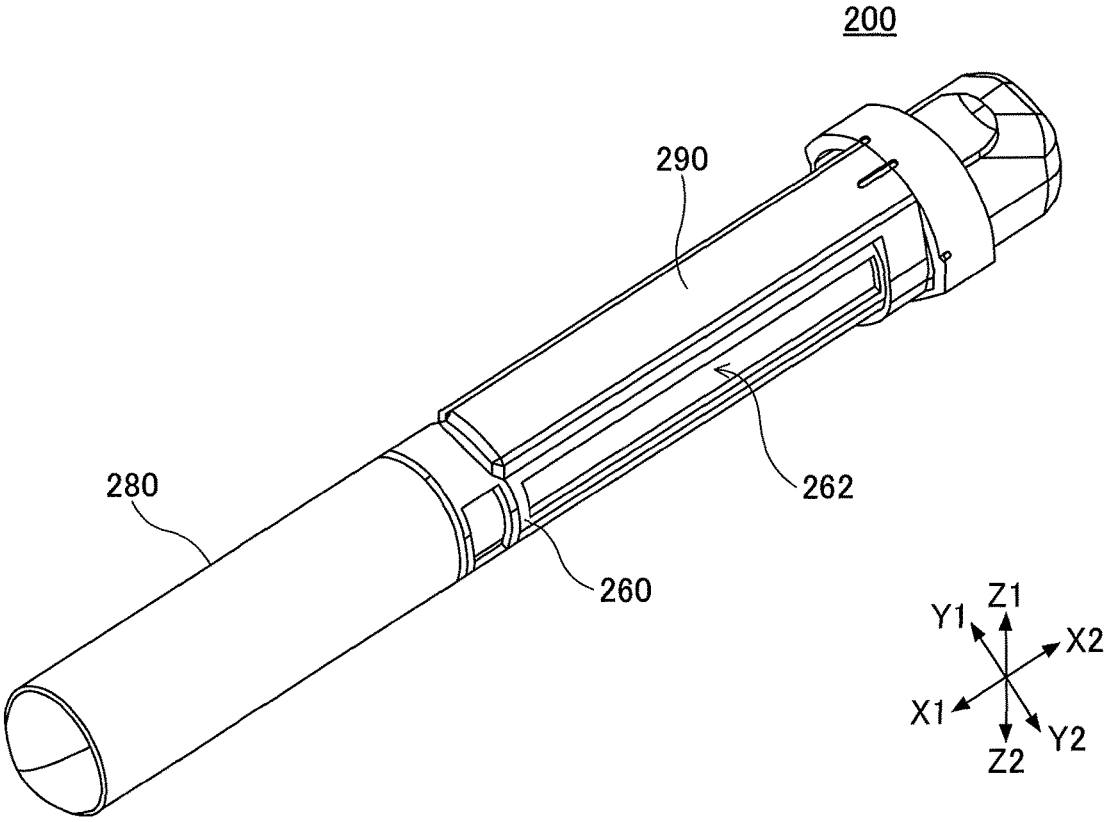
FIG. 7 is a perspective view of a printer according to the embodiment.
Figure 8:
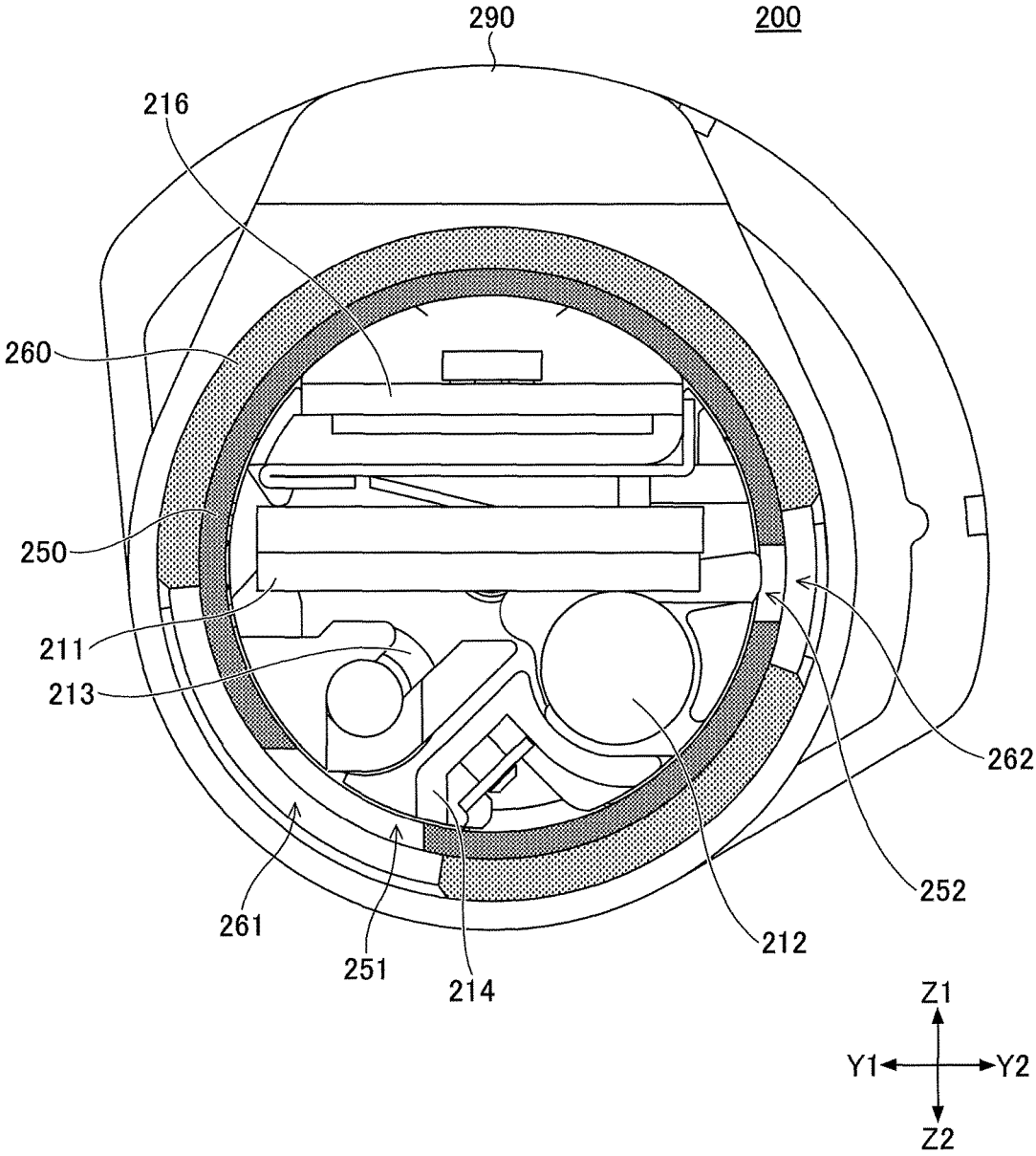
FIG. 8 is a cross-sectional view of the printer according to the embodiment.

The printer 200 is described with reference to FIGS. 7 and 8. FIGS. 7 and 8 are a perspective view and a cross-sectional view, respectively, of the printer 200. The printer 200, which has a cylindrical appearance, is an Internet of Things (IoT) apparatus including a printing function and a radio communication function.

The printer 200 includes a print head 211 such as a thermal head, a platen roller 212, a feed roller 213, a paper guide 214, a spring, a control board 216, an inner cover 250, and an outer cover 260. The print head 211 is pressed against the platen roller 212 by the spring. Recording paper is fed by the feed roller 213, which is slightly adhesive, to move into the printer 200 along the paper guide 214. The recording paper is conveyed by the platen roller 212 while being held between the print head 211 and the platen roller 212, and is thereafter discharged. An electronic circuit and electronic components that control the printer 200 are mounted on the control board 216.

The inner cover 250 and the outer cover 260 are cylindrical, and the inner cover 250 is accommodated in the outer cover 260. The inner cover 250 includes an insert opening 251 and a discharge opening 252 that are open along the generatrix of the inner cover 250. The outer cover 260 includes an insert opening 261 and a discharge opening 262 that are open along the generatrix of the outer cover 260. The outer cover 260 is rotatable relative to the inner cover 250. When the printer 200 performs printing, the insert opening 251 and the insert opening 261 are aligned to be open, and the discharge opening 252 and the discharge opening 262 are aligned to be open. Recording paper enters the printer 200 through the insert openings 251 and 261 that are thus open, and is discharged through the discharge openings 252 and 262 that are thus open.

According to the printer 200, the cassette 300 storing recording paper can be connected to the insert opening 261 with the insert openings 251 and 261 being open to allow printing to be performed. Print data are transmitted from the information terminal 100 to the printer 200 through radio communications using, for example, Bluetooth Low Energy (BLE). The printer 200 receives the print data from an antenna and performs printing on recording paper.

A power supply 280 storing a lithium-ion battery, which is a rechargeable battery, is provided in the housing of the printer 200. The printer 200 can be driven with electric power supplied from the lithium-ion battery.

The printer 200, which is approximately 18 mm in diameter and approximately 165 mm in length, is small and can be carried around without feeling stress. The printer 200 includes a hook 290 which allows the printer 200 to be put in the chest pocket of clothes just like a pen to be carried around.

Figure 9:
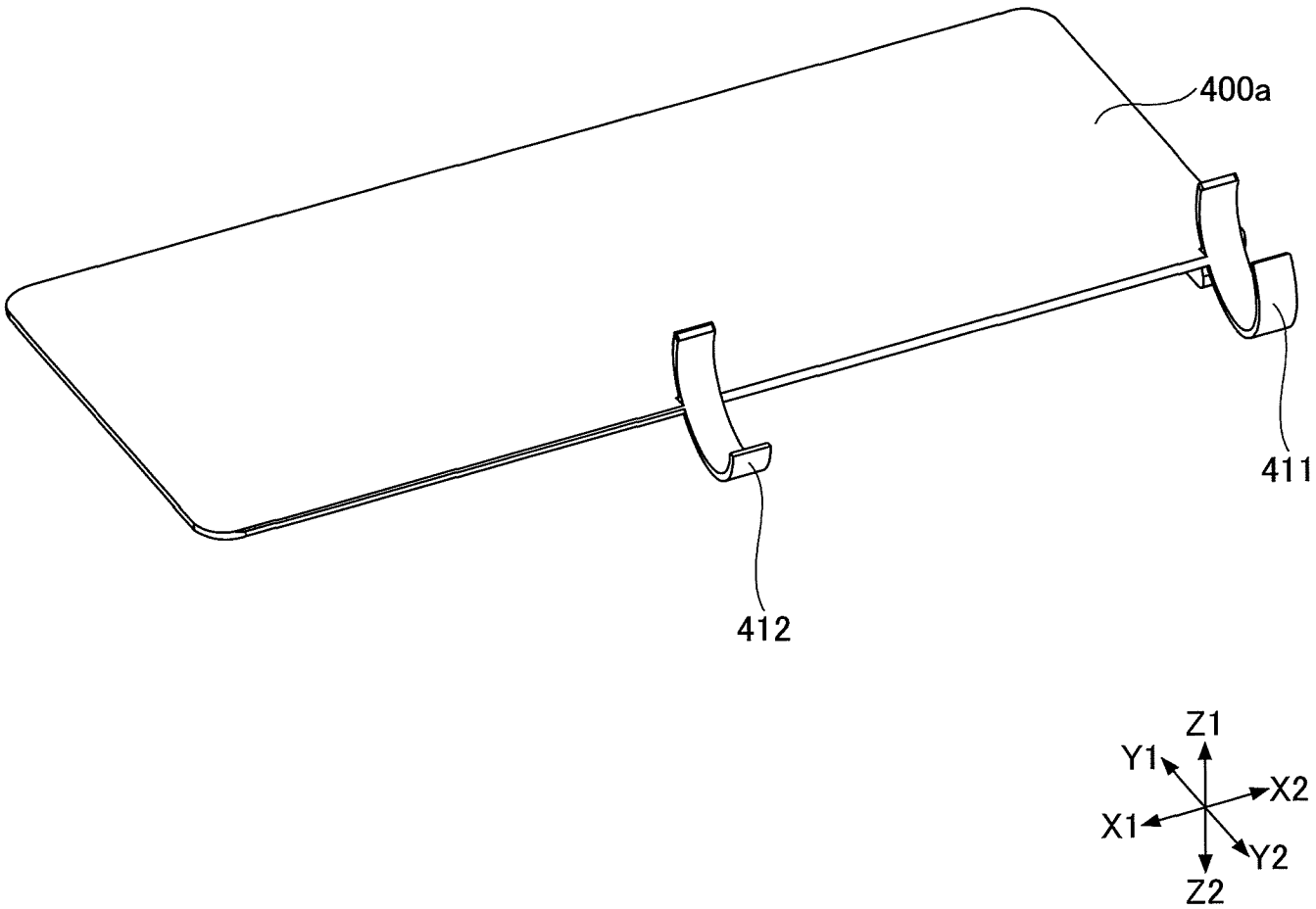
FIG. 9 is a perspective view of a baseplate according to the embodiment.
Figure 10:
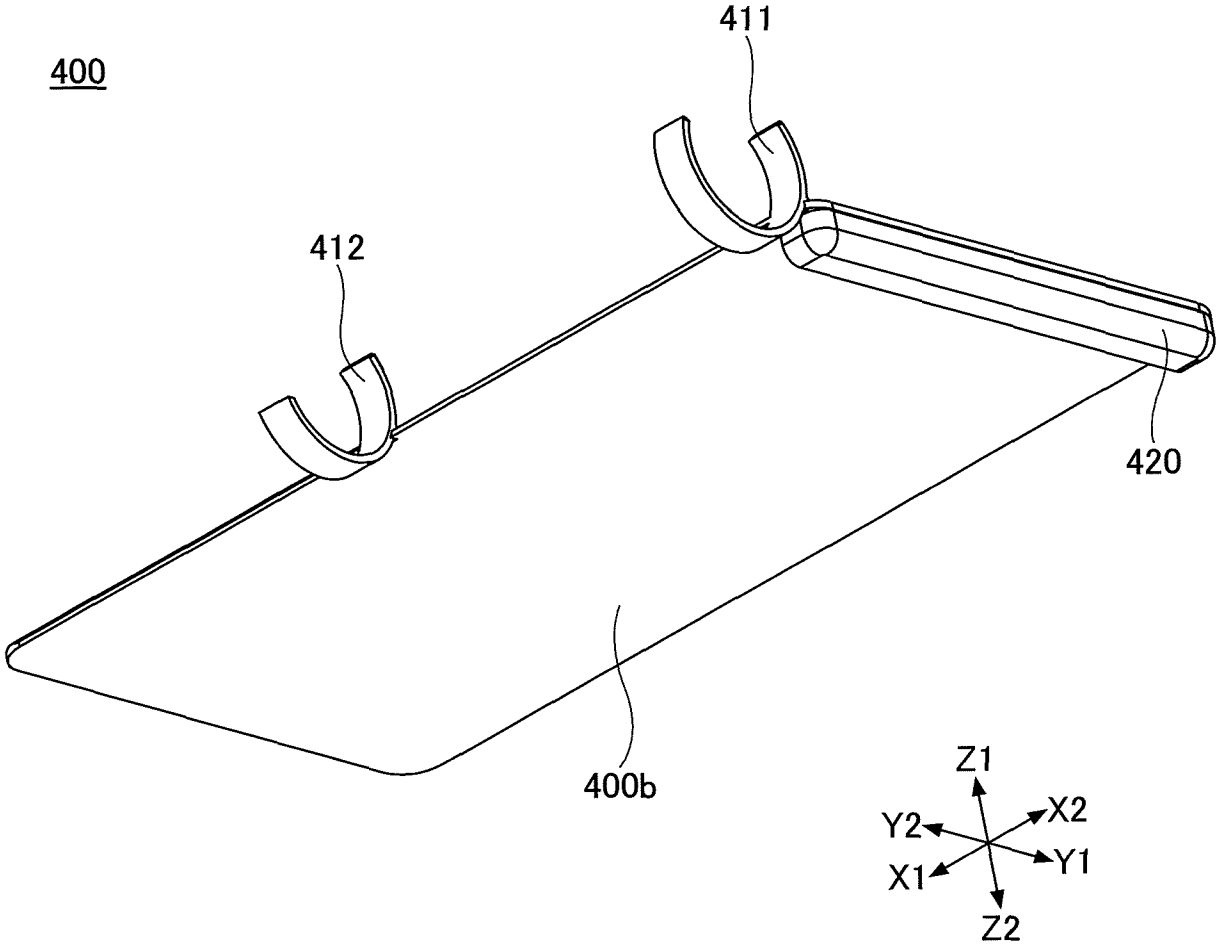
FIG. 10 is another perspective view of the baseplate according to the embodiment.

The baseplate 400 is described with reference to FIGS. 9 and 10. FIGS. 9 and 10 are a top-side perspective view and a bottom-side perspective view, respectively, of the baseplate 400.

The baseplate 400 is formed of, for example, a resin material. The baseplate 400 corresponds in shape to the information terminal 100 and the lower cover 112 to be longer in the X direction than in the Y direction to have a substantially rectangular flat-plate shape. The clips 411 and 412 for attaching the printer 200 are provided at the Y2-side edge of the baseplate 400 that is elongated along the X direction. The clips 411 and 412 have an open ring shape to allow entry of the printer 200. When the printer 200 is attached to and held by the clips 411 and 412, the longitudinal direction of the printer 200 coincides with the X direction, and recording paper is discharged in the Y2 direction.

Referring back to FIGS. 5 and 6, the lower cover 112 is attached to a Z1-side surface 400*a* of the baseplate 400, and the cassette 300 is attached to a Z2-side surface 400*b* of the baseplate 400. Furthermore, a weight 420 for keeping balance is provided on the surface 400*b* near the X2-side end.

Figure 11:
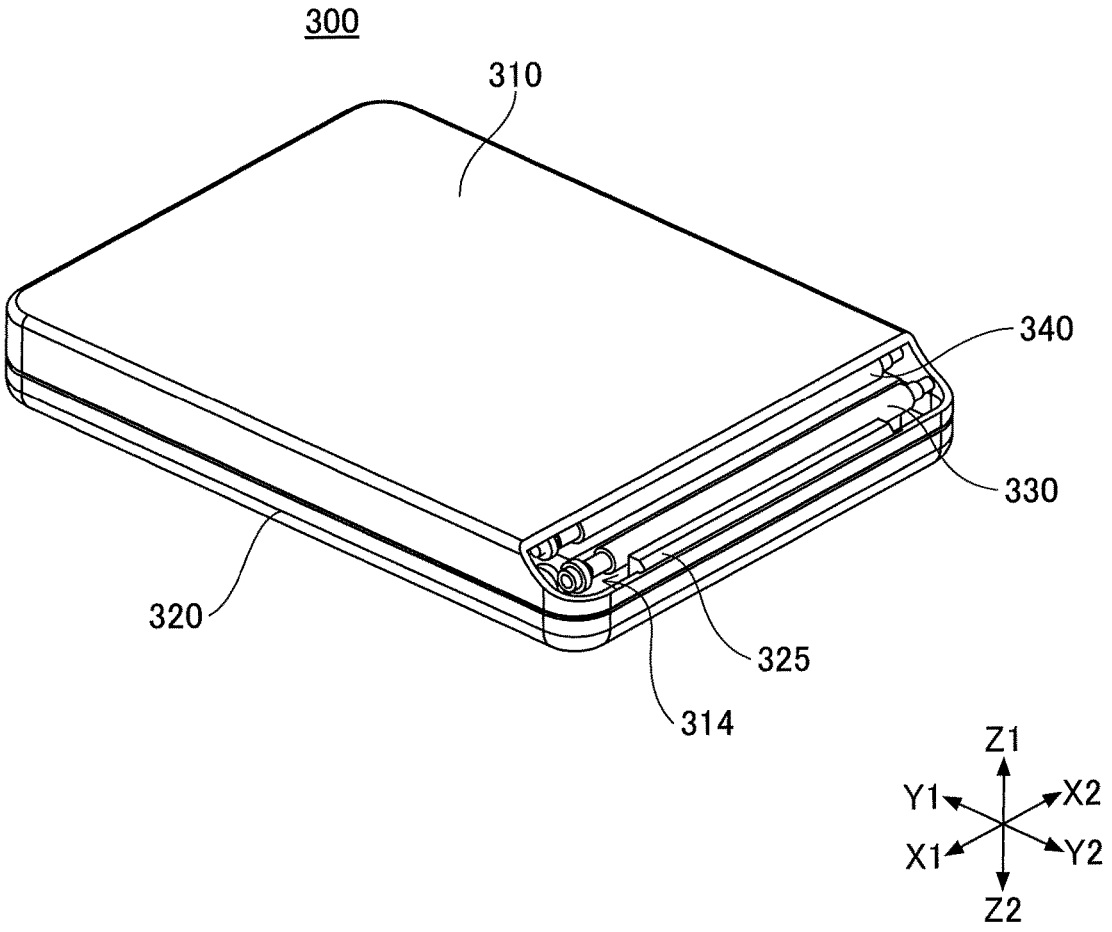
FIG. 11 is a perspective view of a cassette according to the embodiment.
Figure 12:
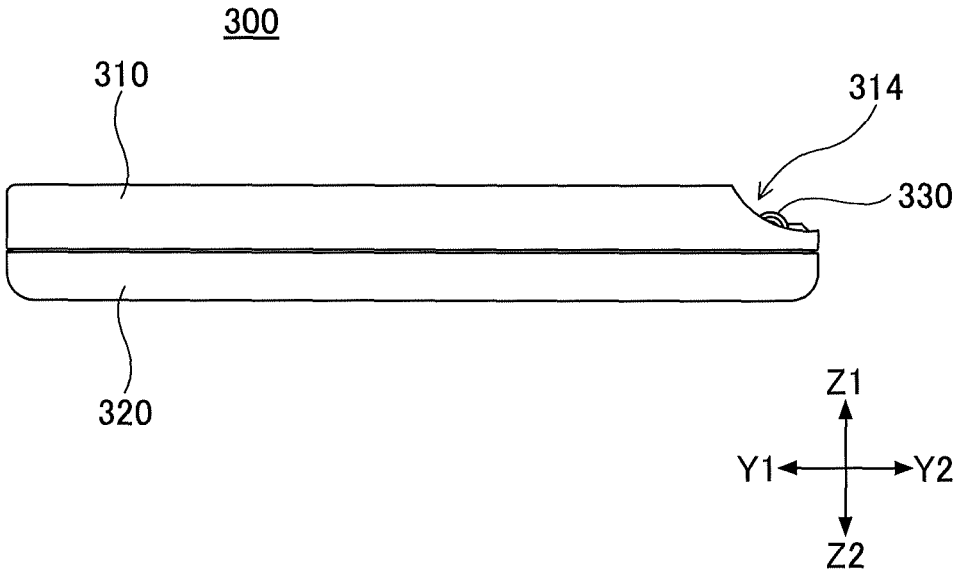
FIG. 12 is a side view of the cassette according to the embodiment.
Figure 13:
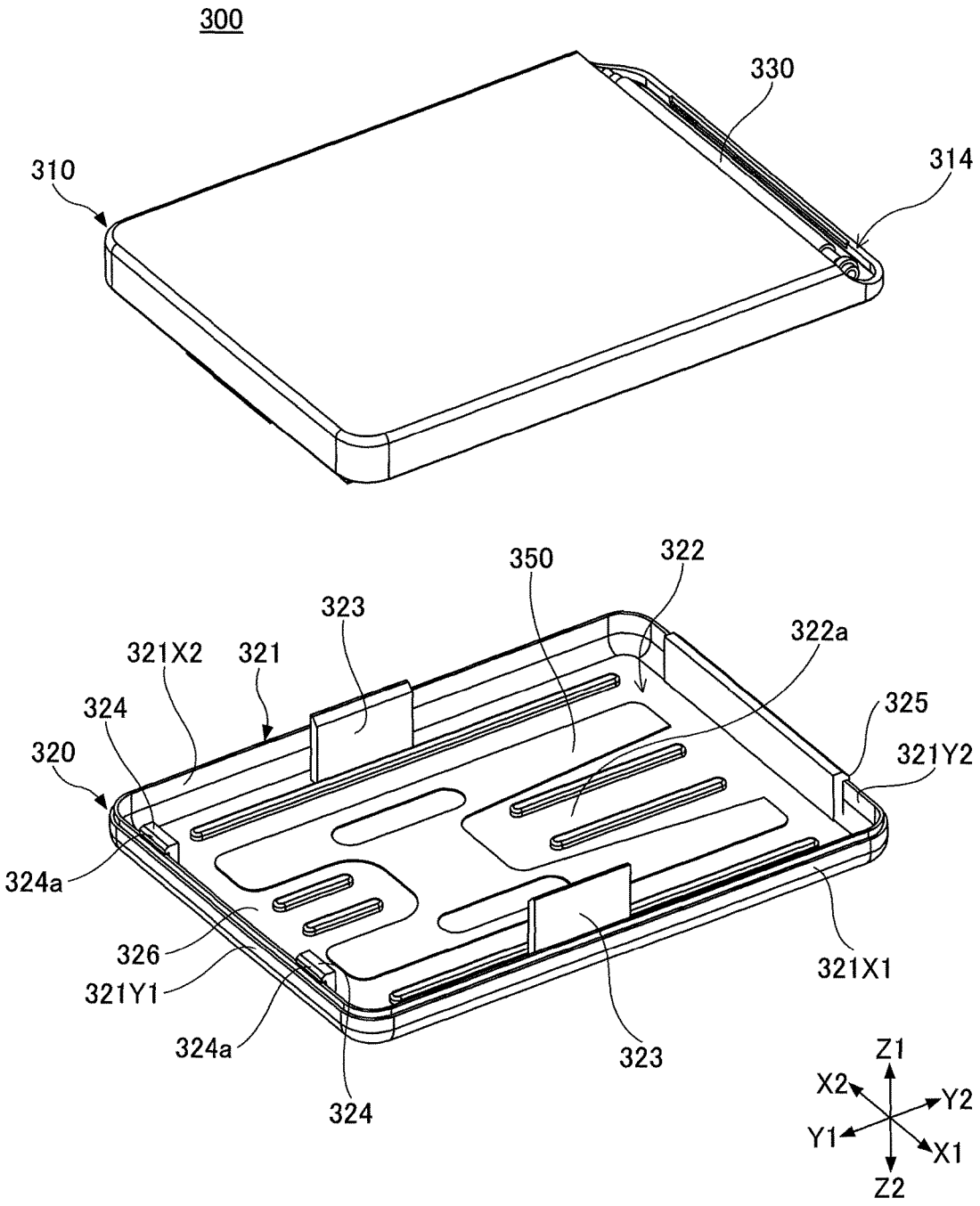
FIG. 13 is an exploded perspective view of the cassette according to the embodiment.
Figure 14:
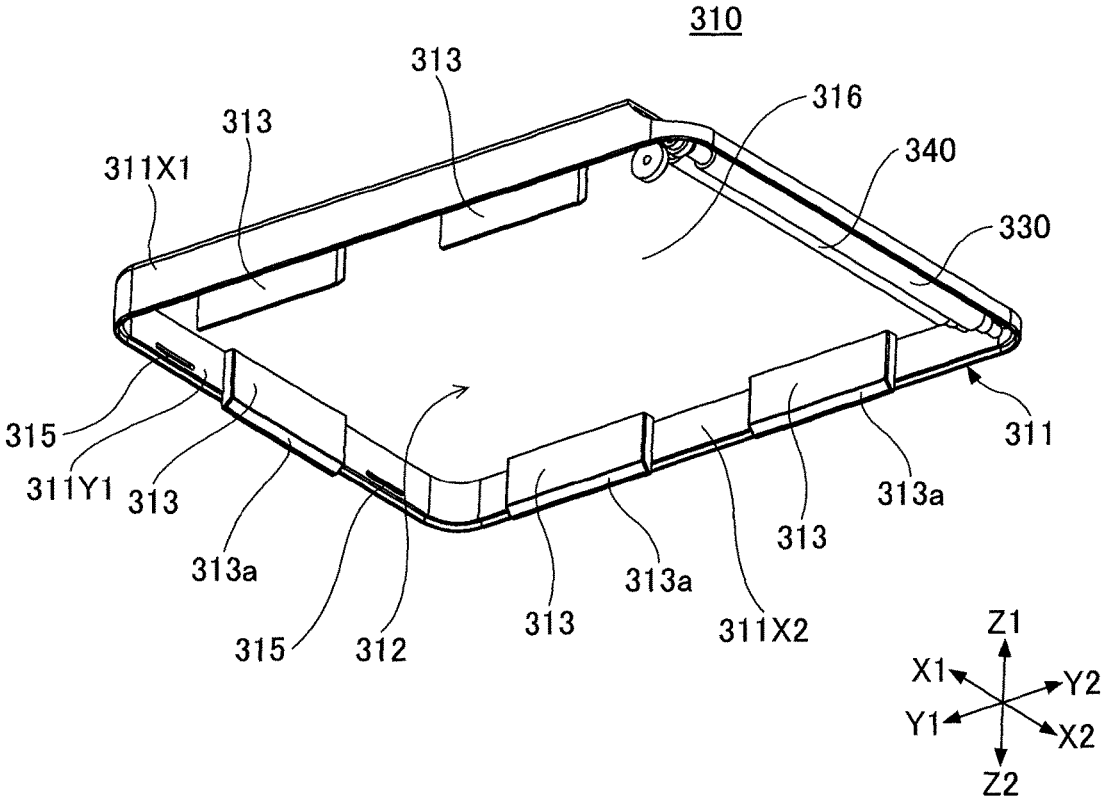
FIG. 14 is a perspective view of an upper case of the cassette according to the embodiment.
Figure 15:
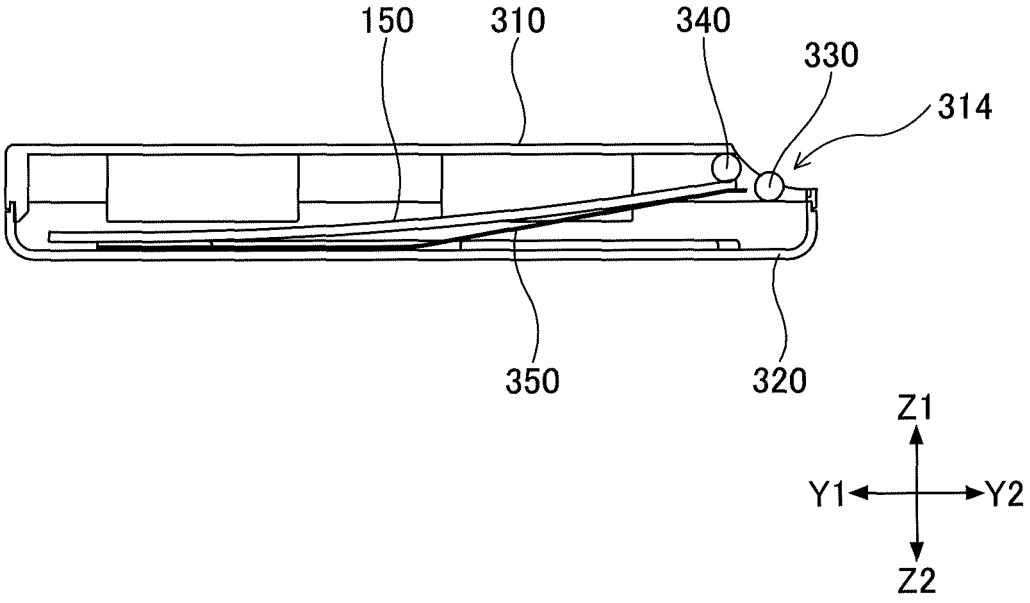
FIG. 15 is a cross-sectional view of the cassette according to the embodiment.

The cassette 300 is described with reference to FIGS. 11 through 15. FIGS. 11, 12 and 13 are a top-side perspective view, a side view and an exploded perspective view, respectively, of the cassette 300. FIG. 14 is a bottom-side perspective view of an upper case of the cassette 300. FIG. 15 is a cross-sectional view of the cassette 300. According to this embodiment, recording paper includes label paper.

The cassette 300 includes an upper case 310, a lower case 320, a first conveying roller 330, and a second conveying roller 340. The cassette 300 is longer in the Y direction than in the X direction to be substantially rectangular. Therefore, the upper case 310 and the lower case 320 are longer in the Y direction than in the X direction.

The upper case 310 includes a top plate 316 and a sidewall 311. The sidewall 311 extends in the Z2 direction from the top plate 316 to define the periphery of the upper case 310, so that a recess 312 is formed inside the sidewall 311. The sidewall 311 includes an X1-side portion 311X1 elongated along the Y direction, an X2-side portion 311X2 elongated along the Y direction, and a Y1-side portion 311Y1 elongated along the X direction. Five paper guides ("guides") 313 are provided on the inner surface of the sidewall 311 to extend in the Z2 direction relative to the top plate 316. Specifically, two of the guides 313 are provided on the inner surface of the portion 311X1 to be arranged side by side along the Y direction, and two of the guides 313 are provided on the inner surface of the portion 311X2 to be arranged side by side along the Y direction. The guides 313 on the X1 side and the guides 313 on the X2 side face each other across the recess 312. Furthermore, the remaining one of the guides 313 is provided on the inner surface of the portion 311Y1.

A Z2-side end of each guide 313 is sloped outward to form a slope 313*a*. As described below, as the printing apparatus performs printing on recording paper 150, the stacked recording paper 150 is reduced to lower the printing apparatus in the Z2 direction. At this point, the slopes 313*a* prevent the printing apparatus from being displaced in the X direction or the Y direction to lose balance, thereby preventing the stacked recording paper 150 from collapsing. The slopes 313*a* gradually widen the space inside the sidewall 311 in the Z2 direction to allow easy entry of the recording paper 150 into the recess 312. Specifically, even when the Y1 and Y2-side edges and/or the X1 and X2-side edges of the recording paper 150 are not aligned so that the Y1 and Y2-side surfaces and/or the X1 and X2-side surfaces of the recording paper 150 are uneven, the slopes 313*a* cause the recording paper 150 to enter the recess 312 as the upper case 310 moves downward with the progress of printing. This prevents the printing apparatus from moving in the X direction or the Y direction to lose balance, thereby preventing the stacked recording paper 150 from collapsing.

The first conveying roller 330 and the second conveying roller 340 are provided on the upper case 310 on its Y2 side to be elongated in the X direction. Furthermore, an opening 314 for supplying the recording paper 150 to the printer 200 is formed in the upper case 310 near the first conveying roller 330 and the second conveying roller 340. In addition, two lock grooves 315 are provided one on each side of the guide 313 in the inner surface of the portion 311Y1 of the sidewall 311.

The lower case 320 includes a bottom plate 326 and a sidewall 321. The sidewall 321 extends in the Z1 direction from the bottom plate 326 to define the periphery of the lower case 320, so that a recess 322 is formed inside the sidewall 321. The sidewall 321 includes an X1-side portion 321X1 elongated along the Y direction, an X2-side portion 321X2 elongated along the Y direction, a Y1-side portion 321Y1 elongated along the X direction, and a Y2-side portion 321Y2 elongated along the X direction. Two guides 323 are provided on the inner surface of the sidewall 321 to extend in the Z1 direction relative to the bottom plate 326. Specifically, one of the guides 323 is provided on the inner surface of the portion 321X1, and the other of the guides 323 is provided on the inner surface of the portion 321X2. The guides 323 face each other across the recess 322. Furthermore, two guides 324 are provided on the inner surface of the portion 321Y1 to be arranged side by side along the X direction. Each guide 324 includes a lock claw 324*a* near its Z1-side end. A lock claw 325 is provided on the inner surface of the portion 321Y2 to be elongated along the X direction.

The upper case 310 and the lower case 320 are connected with the recess 312 and the recess 322 facing each other. In this state, the lock claws 324*a* of the guides 324 enter the lock grooves 315 provided in the inner surface of the sidewall 311, and the lock claw 325 of the lower case 320 engages with the edge of the opening 314, so that the upper case 310 and the lower case 320 are kept connected. The recording paper 150 can be loaded in the space formed between the recesses 312 and 322.

A leaf spring 350 is provided at a bottom 322*a* of the recess 322 (namely, on the Z1-side surface of the bottom plate 326). As illustrated in FIG. 15, the leaf spring 350 lifts up the recording paper 150 in the Z1 direction to bring the recording paper 150 into contact with the second conveying roller 340. As a result, the recording paper 150 can be smoothly supplied even when the recording paper 150 stored in the cassette 300 runs short.

Figure 16:
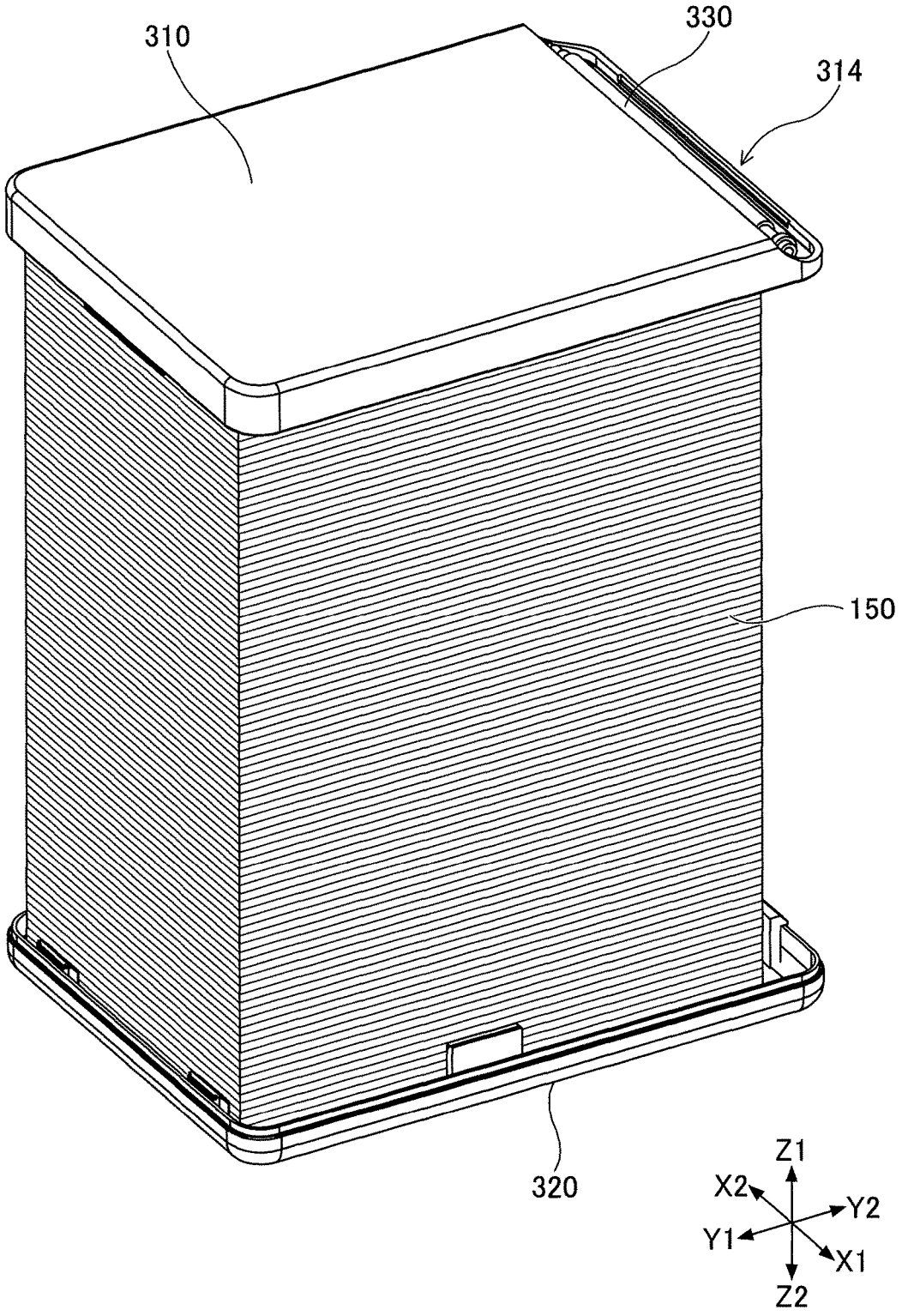
FIG. 16 is a diagram illustrating the cassette according to the embodiment.

According to this embodiment, while the cassette 300 may be used with the upper case 310 and the lower case 320 connected, the upper case 310 and the lower case 320 may be separated to accommodate the recording paper 150 between the separated upper case 310 and lower case 320. As illustrated in FIG. 16, the stacked recording paper 150 may be loaded between the upper case 310 and the lower case 320 with the recesses 312 and 322 facing toward each other. FIG. 16 is a perspective view of the cassette 300 in the above-described state.

When the upper case 310 and the lower case 320 are connected, the recording paper 150 is loaded in the space between the upper case 310 and the lower case 320, and therefore, the number of sheets of the recording paper 150 that can be stored is limited. In contrast, when the upper case 310 and the lower case 320 are separated, a large number of sheets of the recording paper 150 can be loaded between the upper case 310 and the lower case 320. Therefore, it is possible to address the case where the recording paper 150 is large in volume. The size of the recording paper 150 used in this embodiment is, for example, A8 (52 mm×74 mm).

According to this embodiment, a cut sheet is used as recording paper. If rolled paper is to be used, the rolled paper is required to be smaller in radius as the printing apparatus becomes smaller in size. When small-radius rolled paper is used, however, the paper remains tightly curled after printing and is difficult to handle. This phenomenon becomes more conspicuous as the printing apparatus becomes smaller in size. Therefore, a cut sheet which does not curl after printing is used as recording paper in this embodiment. It is of course possible to use rolled paper in the printing apparatus according to this embodiment.

Figure 17:
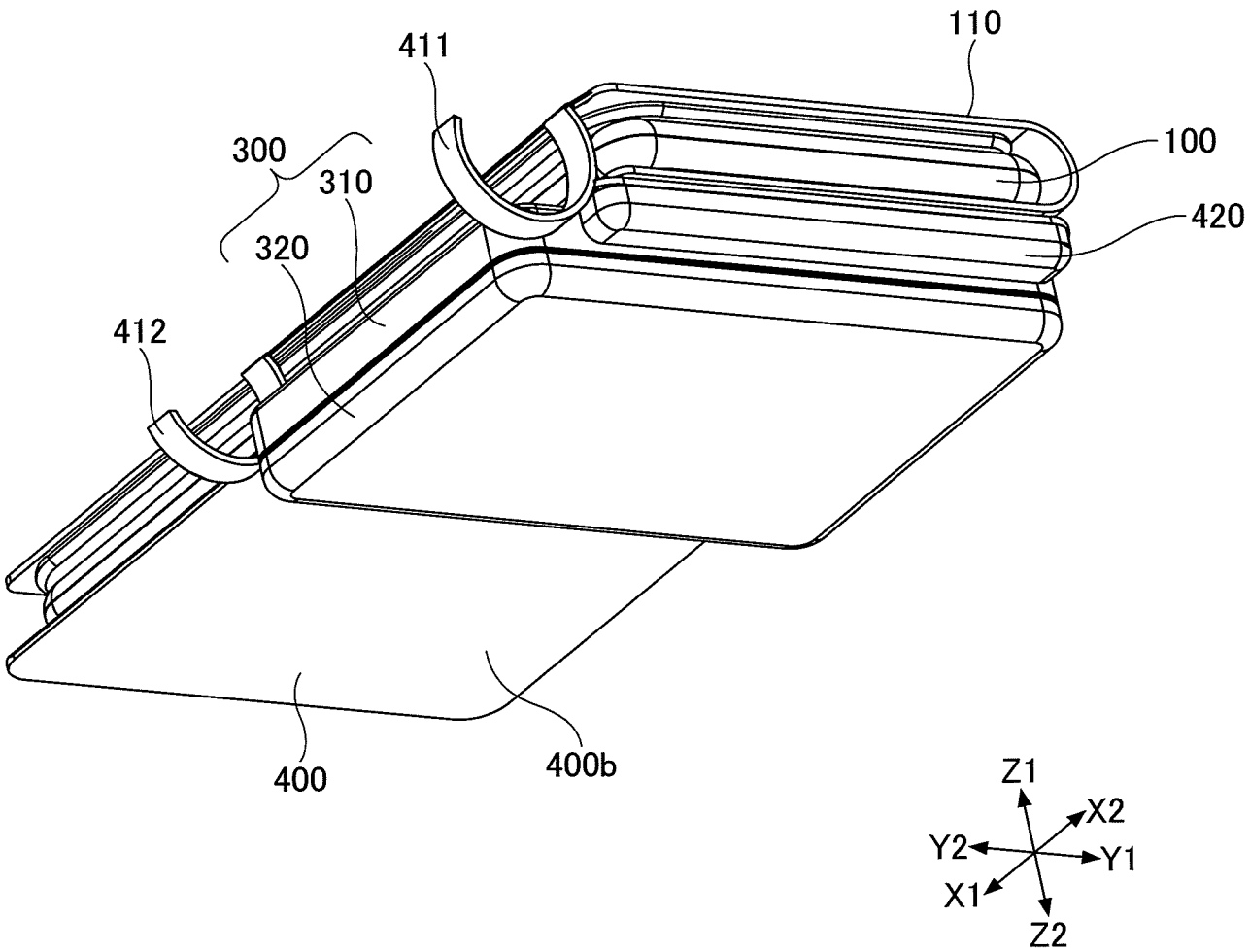
FIG. 17 is a perspective view of the baseplate, and a jacket and the cassette that are attached to the baseplate.
Figure 18:
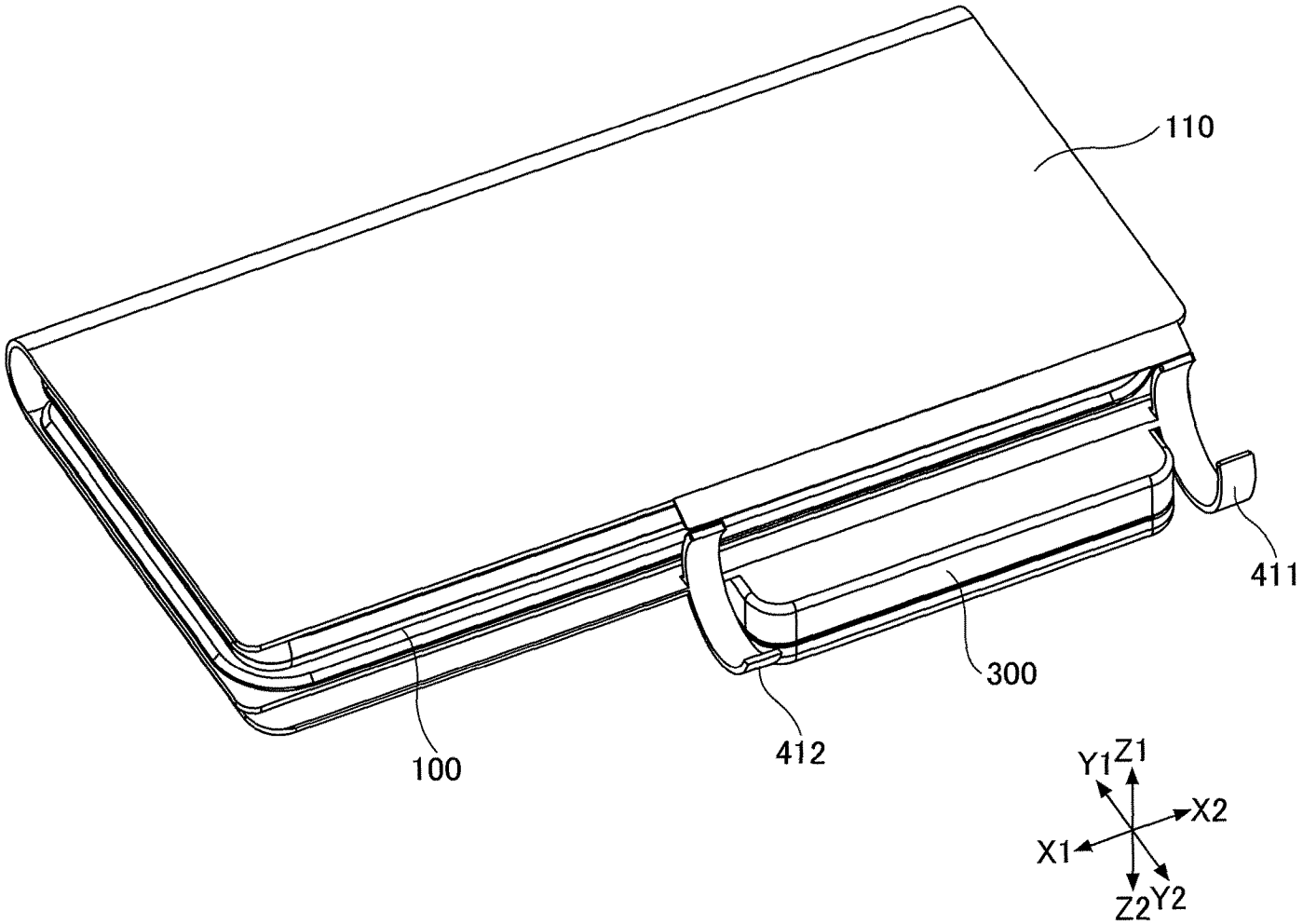
FIG. 18 is another perspective view of the baseplate, and the jacket and the cassette that are attached to the baseplate.

The jacket 110 and the cassette 300 that are connected to each other are described with reference to FIGS. 17 and 18. FIGS. 17 and 18 are a bottom-side perspective view and a top-side perspective view, respectively, of the jacket 110 and the cassette 300 that are connected to each other. In FIGS. 17 and 18, the opening 314 of the cassette 300 is closed by a lid to prevent entry of dust or the like through the opening 314 during the carrying of the printing apparatus.

According to this embodiment, as described with reference to FIG. 6, an outside surface 112*b* of the lower cover 112 is attached to the surface 400*a* of the baseplate 400, and an outside surface of the upper case 310 is attached to the surface 400*b*.

The baseplate 400, the jacket 110, and the cassette 300 may be separable from one another. Alternatively, the baseplate 400 and the jacket 110 may be integrally formed or the baseplate 400 and the upper case 310 may be integrally formed. As yet another alternative, the baseplate 400, the jacket 110, and the upper case 310 of the cassette 300 may be integrally formed.

A battery for driving the printer 200 may be provided on part of the surface 400*b* of the baseplate 400 on the X1 side where the cassette 300 is not attached. In this case, the power supply 280 may be removed from the printer 200, and the printer 200 may be connected to the battery attached to the baseplate 400.

According to this embodiment, by placing the printer 200 into the clips 411 and 412 as illustrated in FIGS. 17 and 18, the printing apparatus illustrated in FIGS. 1 through 4 is achieved. At this point, part of the printer 200 enters the opening 314 of the cassette 300 to connect the opening 314 to the insert opening 251.

Figure 19:
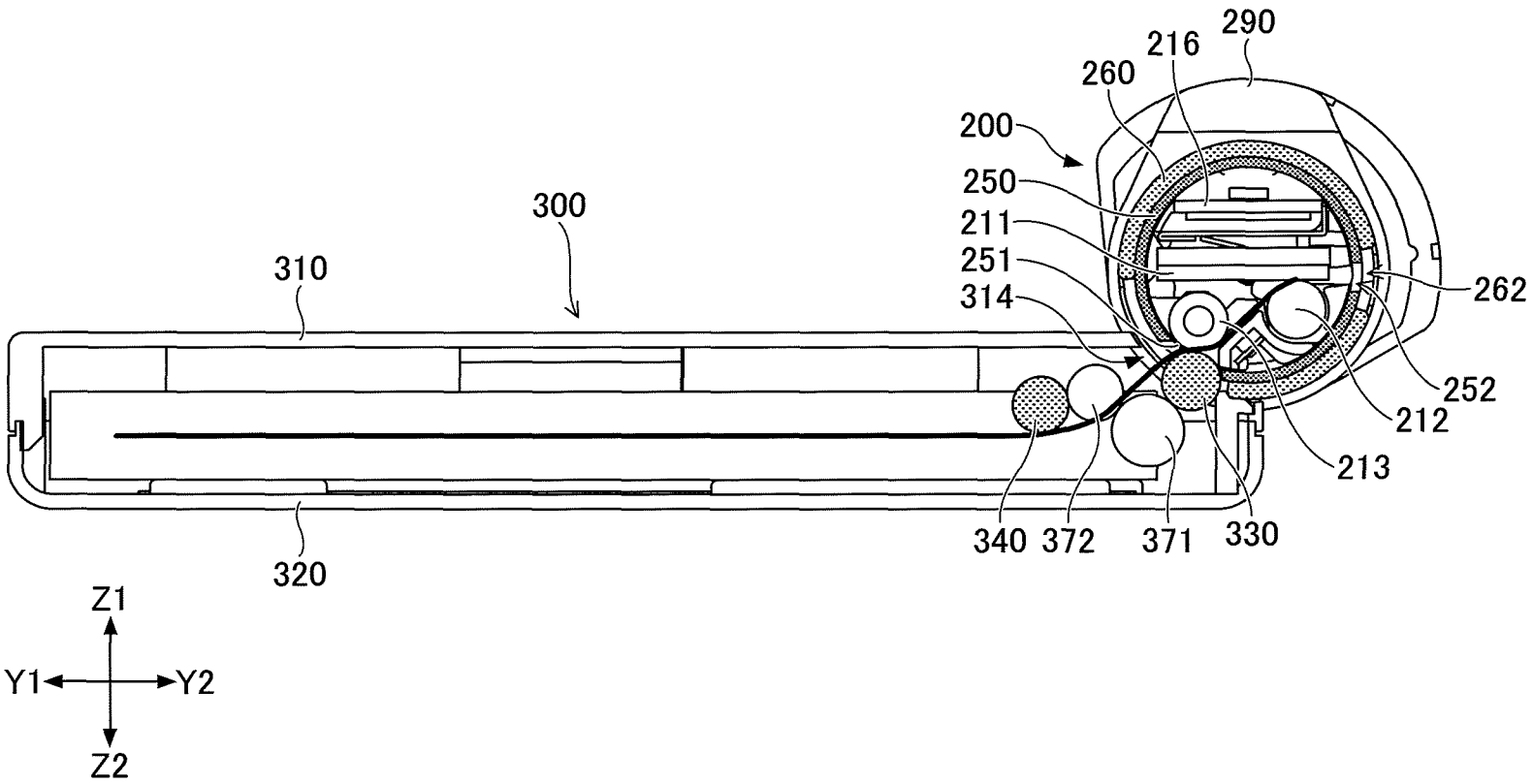
FIG. 19 is a diagram illustrating a printing method of the printing apparatus according to the embodiment.

Printing by the printing apparatus is described with reference to FIG. 19. FIG. 19 illustrates the printer 200 and the cassette 300 that are connected. For convenience of description, the upper case 310 and the lower case 320 that are connected are depicted, and the jacket 110 and the baseplate 400 are omitted in FIG. 19.

When the opening 314 of the cassette 300 communicates with the insert opening 251 of the printer 200 with the printer 200 being placed in the clips 411 and 412, the feed roller 213 contacts the first conveying roller 330. The first conveying roller 330 is rotated by the rotation of the feed roller 213. The cassette 300 includes a first gear 371 and a second gear 372 that rotate the second conveying roller 340 with the rotation of the first conveying roller 330. The first gear 371 is connected to the first conveying roller 330, the second gear 372 is connected to the first gear 371, and the second conveying roller 340 is connected to the second gear 372. For convenience of illustration, the teeth of the first gear 371 and the second gear 372 are omitted in FIG. 19.

When the printer 200 performs printing, the feed roller 213 rotates counterclockwise in FIG. 19 to convey recording paper toward the print head 211. When the feed roller 213 rotates counterclockwise, the first conveying roller 330 contacting the feed roller 213 rotates clockwise, and the rotation of the first conveying roller 330 is transmitted to the second conveying roller 340 via the first gear 371 and the second gear 372. When the first conveying roller 330 rotates clockwise, the second conveying roller 340 rotates counterclockwise.

The second conveying roller 340 is in contact with a surface of the top sheet. As the second conveying roller 340 rotates counterclockwise, the recording paper moves in the Y2 direction to be conveyed toward the printer 200, and passes through the opening 314 and the insert opening 251 to be conveyed toward the print head 211, being held between the feed roller 213 and the first conveying roller 330. The first conveying roller 330 and the second conveying roller 340 have a one-way clutch function.

To perform printing in the printing apparatus, the upper cover 111 is opened, and the touchscreen of the information terminal 100 is operated to input instructions for printing to the information terminal 100. By inputting instructions through operations on the touchscreen, print information stored in a memory of the information terminal 100 and a print command signal are transmitted to the printing apparatus by communications using, for example, BLE, and printing is performed based on this information.

A method of using a printing apparatus according to this embodiment is described with reference to FIG. 20. According to this embodiment, with the upper case 310 and the lower case 320 of the cassette 300 being separated to have the recess 312 and the recess 322 facing each other, the stacked recording paper 150 is loaded between the upper case 310 and the lower case 320. By loading the recording paper 150 in this manner, a large number of sheets, for example, 100 through 300 sheets, of the recording paper 150 can be loaded in the cassette 300 irrespective of the size of the cassette 300, so that it is possible to address the case where it is desired to perform printing on a large number of sheets of recording paper. By separating the upper case 310 and the lower case 320, a virtual stack holder (VSH) that has no sidewalls on the side surfaces of the stacked recording paper 150 is formed. The printing apparatus can be carried around with the upper case 310 and the lower case 320 being connected.

Figure 20:
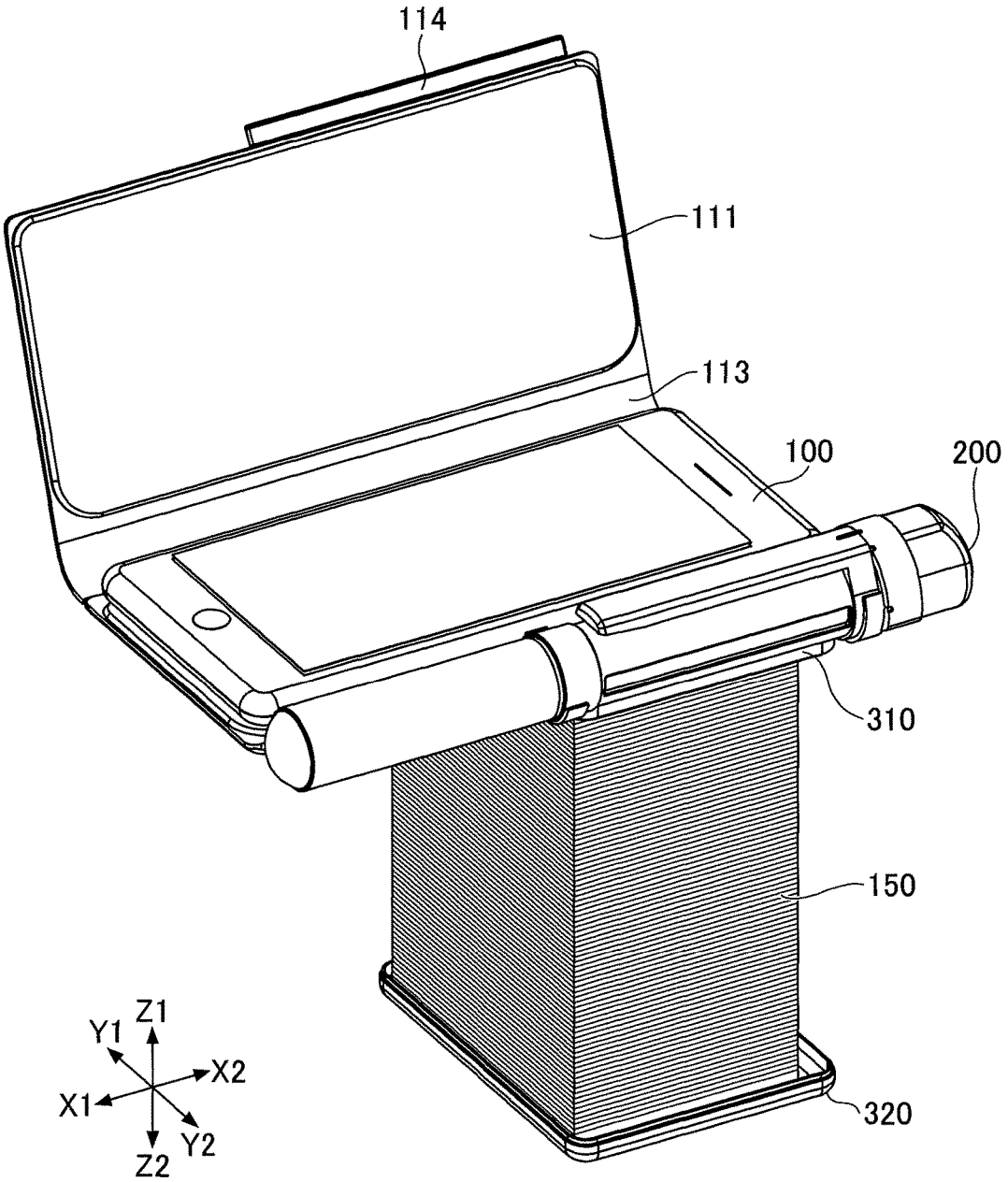
FIG. 20 is a diagram illustrating the case of using a stack of cut sheets in the printing apparatus according to the embodiment.

According to this embodiment, the weight 420 serving as an adjuster to adjust the center of gravity of the printing apparatus is provided on the baseplate 400 near its X2-side end in order for the printing apparatus to maintain the posture as illustrated in FIG. 20 without losing balance even when the stacked recording paper 150 is high as illustrated in FIG. 20. The weight and the installation position of the weight 420 are adjusted so that the center of gravity of the printing apparatus coincides with the center of the paper plane of the recording paper 150. The provision of the weight 420 prevents the printing apparatus from losing balance and prevents the stacked recording paper 150 from collapsing even when a large number of sheets of the recording paper 150 are loaded between the upper case 310 and the lower case 320. The weight 420 is attached so that the center of gravity of a structure formed of the baseplate 400; the printer 200, the jacket 110, and the upper case 310 of the cassette 300 attached to the baseplate 400; and the information terminal 100 held on the jacket 110 coincides with the center of the paper plane of the recording paper 150. Without the weight 420, the information terminal 100 in the posture of FIG. 20 is lighter on its head side (the X2 side) in its longitudinal direction. Therefore, the weight 420 is attached to the Z2-side surface 400*b* of the baseplate 400 on the X2 side to offset turning moment. In the width direction of the recording paper 150, the information terminal 100 is uniform in weight, and therefore, the balance is maintained using the jacket 110, the printer 200, and the upper case 310.

When the printing apparatus is thus placed on the recording paper 150, the weight of the printing apparatus is added to the stacked recording paper 150, and the top sheet of the recording paper 150 is therefore in contact with the second conveying roller 340.

When the second conveying roller 340 rotates, the top sheet is conveyed in the Y2 direction toward the insert opening 251. To prevent the second top and subsequent sheets of the recording paper 150 from being conveyed together with the top sheet, the upper case 310 may include an engaging part that holds the leading edges of the second top and subsequent sheets when the second conveying roller 340 rotates to convey the top sheet in the Y2 direction.

Figure 21:
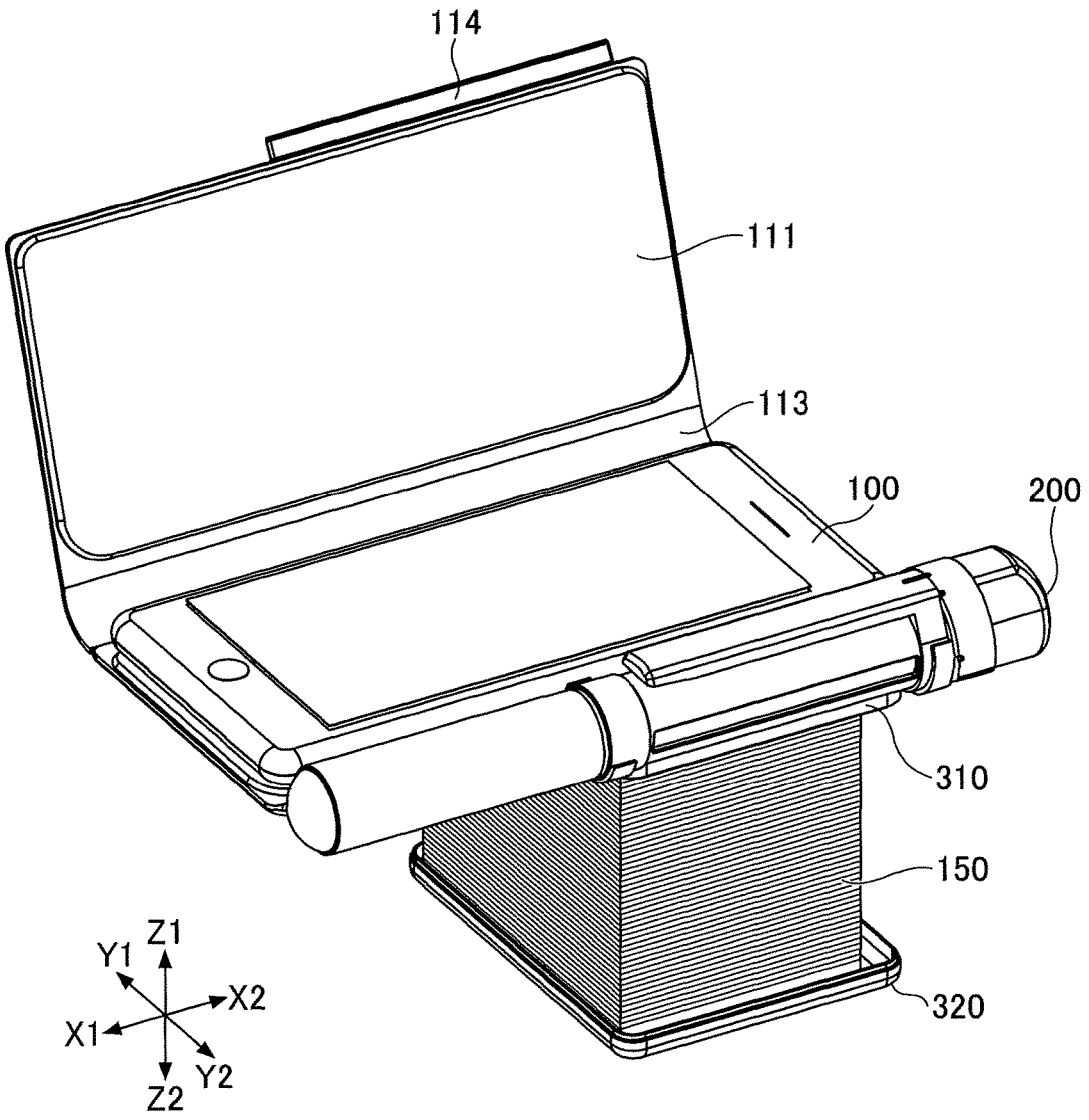
FIG. 21 is a diagram illustrating the case of using the stack of cut sheets in the printing apparatus according to the embodiment.

As the printing apparatus performs printing on the recording paper 150, the height of the stacked recording paper 150 is gradually reduced as illustrated in FIG. 21. As the printing further progresses, the upper case 310 and the lower case 320 are connected as illustrated in FIG. 2. In this state, the recording paper 150 is pushed upward in the Z1 direction by the leaf spring 350 as illustrated in FIG. 15. Therefore, the surface of the top sheet is kept in contact with the second conveying roller 340.

Figure 22:
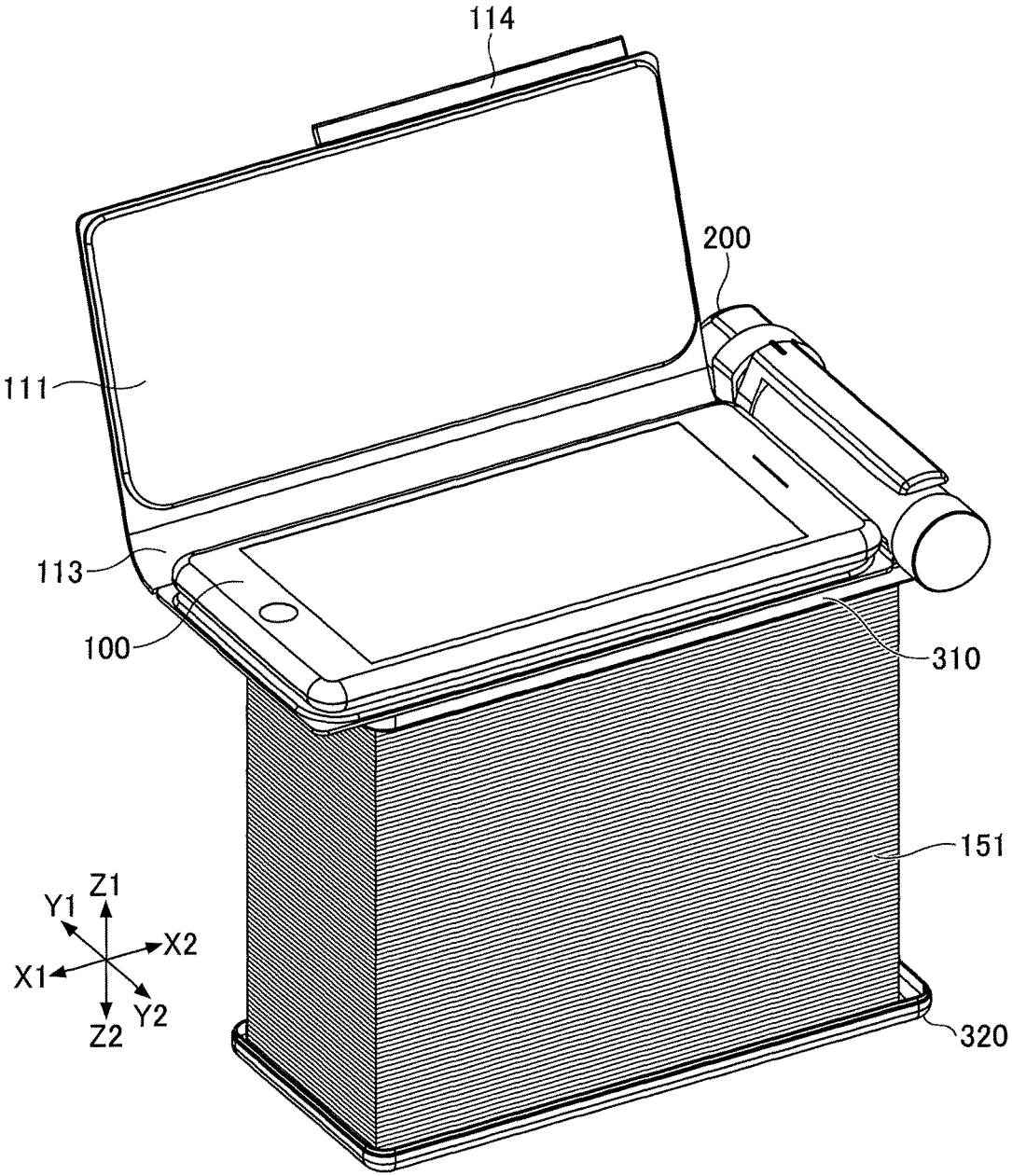
FIG. 22 is a diagram illustrating the case of using the stack of cut sheets in the printing apparatus according to the embodiment.

As illustrated in FIG. 22, the printing apparatus can perform printing on long-size recording paper 151. FIG. 22 is a perspective view of an arrangement for perform printing on the recording paper 151.

In the arrangement illustrated in FIG. 22, the recording paper 151 is set to be elongated in the X direction, and the printer 200 is installed at the X2-side end of the baseplate 400. In FIG. 22, the power supply 280 is removed from the printer 200. A clip is provided at the X2-side edge of the baseplate 400 instead of the clips 411 and 412. The printer 200 is installed to be elongated in the Y direction, and the recording paper 151 is discharged in the X2 direction. In this case, a power supply for the printer 200 may be provided on the surface 400*b* of the baseplate 400 near its X1-side end.

Figure 23:
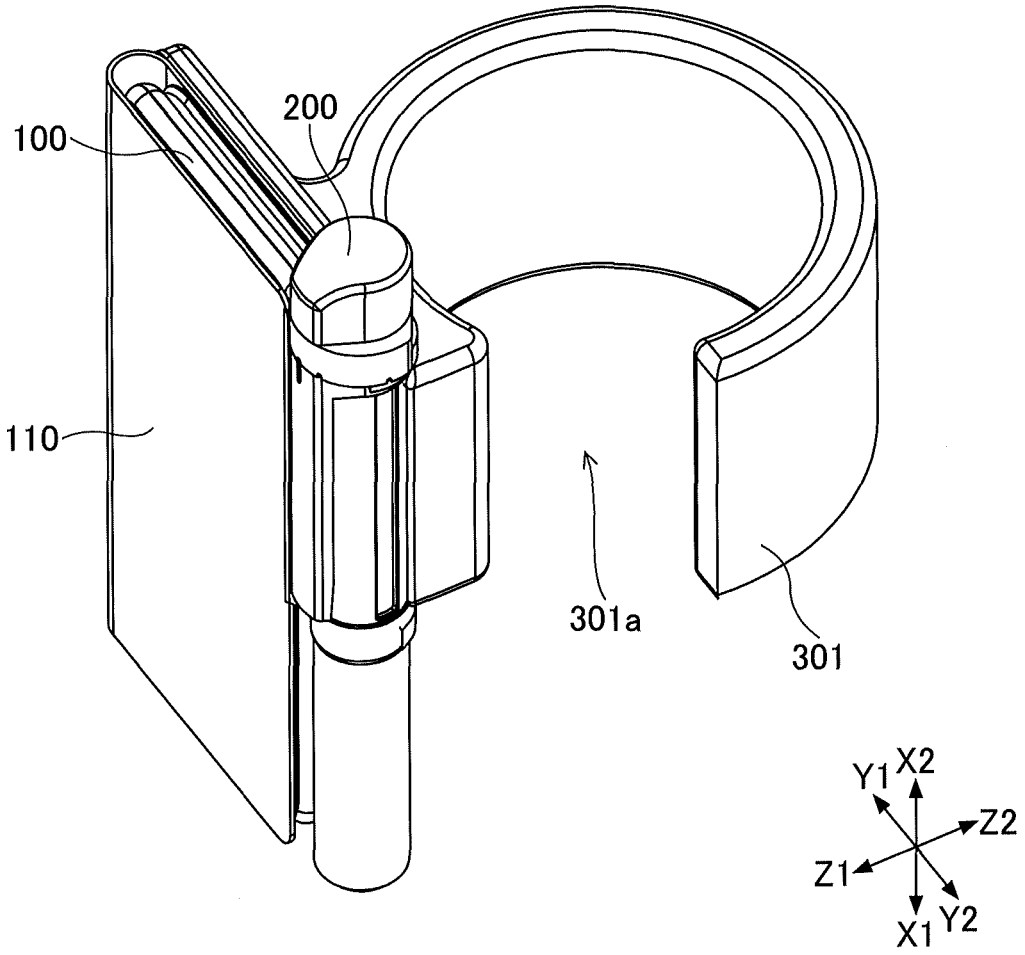
FIG. 23 is a perspective view of a different type of cassette according to the embodiment.
Figure 24:
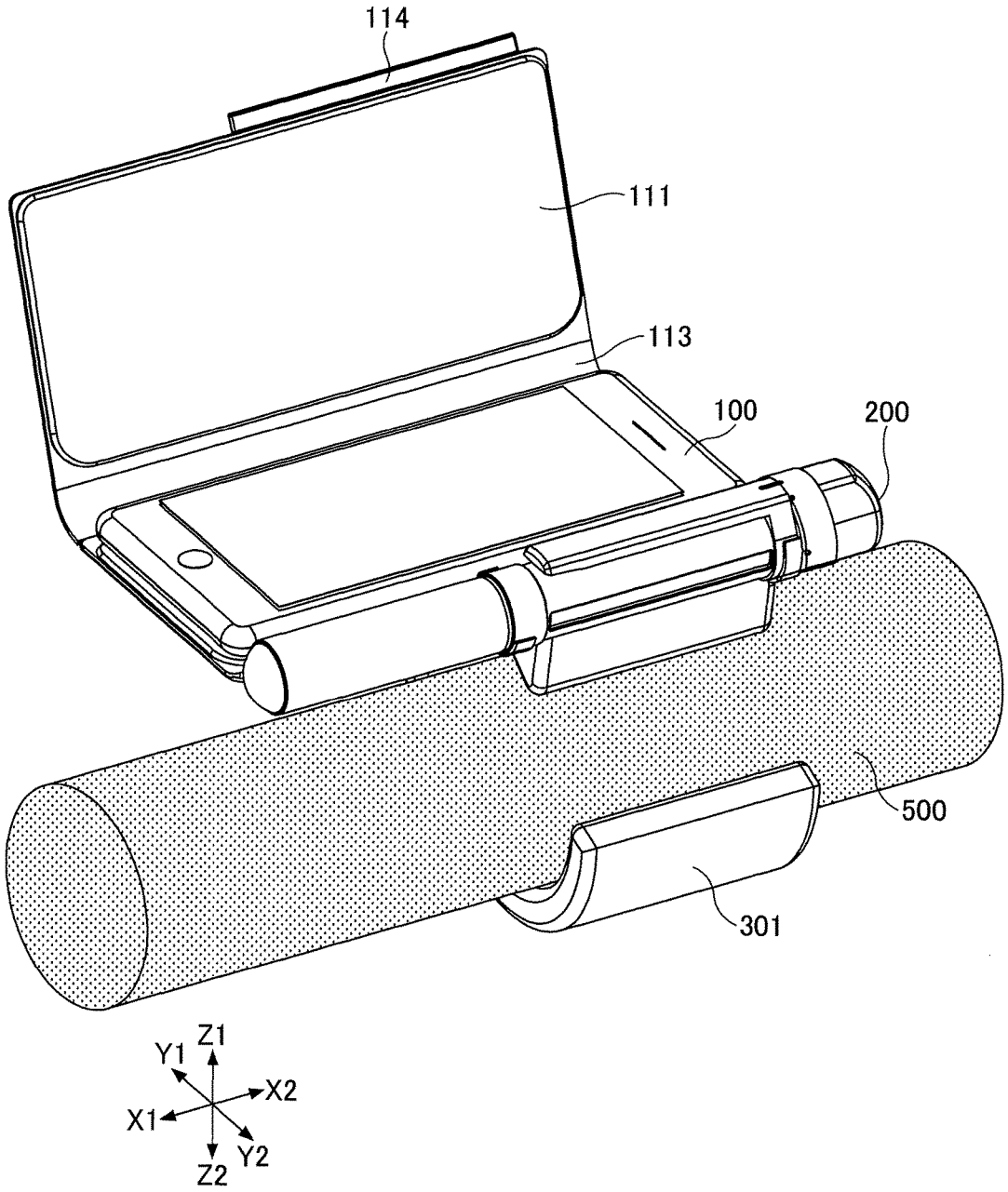
FIG. 24 is a diagram illustrating the different type of cassette according to the embodiment.

According to this embodiment, a clip-on cassette 301 having a cylindrical shape as illustrated in FIG. 23 may be used instead of the cassette 300. The cassette 301 includes a clip that forms an opening 301*a*. The clip is an arm clip that may be attached to an arm and the like. Recording paper may be loaded in the cassette 301. By inserting a cylindrical support 500 for supporting the printing apparatus into the opening 301*a*, the cassette 301 can be freely attached to the support 500 as illustrated in FIG. 24 to increase latitude in work such as printing.

In the case of long recording paper having a length of 150 mm, the cassette 301 can accommodate approximately 20 to 30 sheets. Because a cylindrical portion of the cassette 301 has a large radius, recording paper hardly curls. The cassette 301 can also accommodate short sheets having a smaller length instead of long sheets. In this case, the cassette 301 can accommodate approximately 100 to approximately 150 short sheets.

According to such a printing apparatus as well, information from the information terminal 100 can be printed on recording paper and output based on operations on the touchscreen of the information terminal 100.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A printing apparatus comprising:

a printer configured to perform printing on a recording sheet;

a baseplate that holds the printer detachably attached to the baseplate;

a jacket attached to a first surface of the baseplate, the jacket including a first cover and a second cover and configured to hold an information terminal between the first cover and the second cover; and a container attached to a second surface of the baseplate facing away from the first surface, and configured to store the recording sheet.

2. A printing apparatus comprising:

a printer configured to perform printing on a recording sheet;

a feed roller provided in the printer, and configured to feed the recording sheet;

a baseplate that holds the printer;

a container attached to a first surface of the baseplate, and configured to store the recording sheet;

a first conveying roller provided in the container, and configured to rotate in contact with the feed roller; and a second conveying roller provided in the container, and configured to rotate with a rotation of the first conveying roller and to contact a surface of the recording sheet stored in the container.

3. The printing apparatus as claimed in claim 2, further comprising:

a jacket attached to a second surface of the baseplate opposite to the first surface, and configured to hold an information terminal.

4. A printing apparatus comprising:

a printer configured to perform printing on a recording sheet;

a baseplate that holds the printer; and a container attached to a first surface of the baseplate, and configured to store the recording sheet, wherein the container includes a first case and a second case that are separable from each other, and the container is configured to store a stack of recording sheets between the first case and the second case.

5. The printing apparatus as claimed in claim 4, further comprising:

an adjuster provided on the baseplate, and configured to adjust a center of gravity of the printing apparatus.

6. The printing apparatus as claimed in claim 4, wherein the container further includes a spring provided in the second case, the spring being configured to urge the recording sheet toward the first case.

7. The printing apparatus as claimed in claim 4, wherein the baseplate and the first case are integrally formed.

8. The printing apparatus as claimed in claim 4, further comprising:

a jacket attached to a second surface of the baseplate opposite to the first surface, and configured to hold an information terminal.

9. A printing apparatus comprising:

a printer configured to perform printing on a recording sheet;

a baseplate;

a clip provided on the baseplate, and configured to hold the printer; and a container attached to a first surface of the baseplate, and configured to store the recording sheet, wherein the printer is placed in the clip to be elongated along the baseplate.

10. The printing apparatus as claimed in claim 9, further comprising:

a jacket attached to a second surface of the baseplate opposite to the first surface, and configured to hold an information terminal.

* * * * *